US012078036B2

(12) United States Patent
Poizat et al.

(10) Patent No.: US 12,078,036 B2
(45) Date of Patent: Sep. 3, 2024

(54) SINGLE TRIP WELLBORE COMPLETION SYSTEM

(71) Applicant: Schlumberger Technology Corporation, Sugar Land, TX (US)

(72) Inventors: Jeremie Poizat, Houston, TX (US); John Whitsitt, Houston, TX (US); Oguzhan Guven, Bellaire, TX (US); Michael Huh, Pearland, TX (US); Nabil Batita, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 136 days.

(21) Appl. No.: 17/907,562

(22) PCT Filed: Apr. 7, 2021

(86) PCT No.: PCT/US2021/026104
§ 371 (c)(1),
(2) Date: Sep. 28, 2022

(87) PCT Pub. No.: WO2021/207304
PCT Pub. Date: Oct. 14, 2021

(65) Prior Publication Data

US 2023/0147546 A1 May 11, 2023

Related U.S. Application Data

(60) Provisional application No. 63/006,994, filed on Apr. 8, 2020.

(51) Int. Cl.
*E21B 43/10* (2006.01)
*E21B 23/06* (2006.01)
(Continued)

(52) U.S. Cl.
CPC ..... *E21B 43/10* (2013.01); *E21B 23/06* (2013.01); *E21B 33/1208* (2013.01);
(Continued)

(58) Field of Classification Search
CPC ..... E21B 43/10; E21B 43/14; E21B 41/0035; E21B 23/06
See application file for complete search history.

(56) References Cited

U.S. PATENT DOCUMENTS 5,921,318 A 7/1999 Ross
6,446,729 B1 9/2002 Bixenman et al.
(Continued)

FOREIGN PATENT DOCUMENTS

EP 2184436 A2 5/2010
EP 2631423 A1 8/2013
(Continued)

OTHER PUBLICATIONS

International Search Report and Written Opinion issued in PCT Application PCT/US2021/026104 dated Aug. 2, 2021 (12 pages).
(Continued)

*Primary Examiner* — David Carroll
(74) *Attorney, Agent, or Firm* — Jeffrey D. Frantz

(57) ABSTRACT

A completion string includes at least one isolation packer positioned between well zones of a plurality of well zones, and a sand control assembly and a circulating assembly each disposed uphole of a washdown shoe in the bottom-most well zone. A top well zone includes a return valve assembly, a production packer, and a second circulating assembly and a second sand control assembly downhole of the production packer. The completion string also includes an outer string spanning from the bottom-most well zone to the top well zone, and an inner production string concentrically arranged within the outer string, creating an inner-annulus between
(Continued)

Detail B the outer string and inner production string. The inner-annulus is continuous from the washdown shoe to the return valve assembly, and the inner production string includes a production valve disposed between the sand control assembly and the circulating assembly in each of the bottom-most and top well zones.

23 Claims, 16 Drawing Sheets

(51) Int. Cl.
*E21B 33/12* (2006.01)
*E21B 34/06* (2006.01)
*E21B 34/14* (2006.01)

(52) U.S. Cl.
CPC ..... *E21B 34/063* (2013.01); *E21B 34/142* (2020.05); *E21B 2200/04* (2020.05)

(56) References Cited

U.S. PATENT DOCUMENTS

| | | | | |
|---|---|---|---|---|
| 6,681,854 | B2 | 1/2004 | Danos | |
| 6,684,952 | B2 | 2/2004 | Brockman et al. | |
| 7,165,618 | B2 | 1/2007 | Brockman et al. | |
| 7,562,709 | B2 | 7/2009 | Saebi et al. | |
| 7,918,276 | B2 | 4/2011 | Guignard et al. | |
| 8,127,845 | B2 | 3/2012 | Assal | |
| 8,496,055 | B2 | 7/2013 | Mootoo et al. | |
| 8,511,380 | B2 | 8/2013 | Guignard et al. | |
| 8,988,178 | B2 | 3/2015 | Deville et al. | |
| 9,000,873 | B2 | 4/2015 | Deville et al. | |
| 9,638,012 | B2 | 5/2017 | Yeh et al. | |
| 2002/0117301 | A1 | 8/2002 | Womble | |
| 2002/0189809 | A1 | 12/2002 | Nguyen et al. | |
| 2002/0195253 | A1 | 12/2002 | Hill, Jr. et al. | |
| 2009/0025923 | A1 | 1/2009 | Patel et al. | |
| 2010/0175894 | A1* | 7/2010 | Debard | E21B 34/10 166/382 |
| 2013/0000899 | A1* | 1/2013 | Broussard | E21B 33/124 166/278 |
| 2014/0034336 | A1 | 2/2014 | Jasek | |
| 2014/0083766 | A1* | 3/2014 | Tips | E21B 44/00 175/24 |
| 2015/0047837 | A1 | 2/2015 | Turner et al. | |
| 2015/0053408 | A1 | 2/2015 | Purkis et al. | |
| 2015/0075780 | A1* | 3/2015 | Richards | E21B 43/04 166/308.1 |
| 2015/0198016 | A1 | 7/2015 | Langlais | |
| 2015/0315895 | A1 | 11/2015 | Patel et al. | |
| 2017/0138158 | A1* | 5/2017 | Bourgneuf | E21B 43/04 |
| 2017/0241214 | A1 | 8/2017 | Billingham | |
| 2017/0342810 | A1 | 11/2017 | Richards | |
| 2018/0163486 | A1* | 6/2018 | Davies | E21B 43/10 |
| 2020/0141211 | A1* | 5/2020 | Franklin | E21B 34/066 |
| 2021/0123327 | A1 | 4/2021 | Langlais et al. | |
| 2021/0363862 | A1 | 11/2021 | Langlais | |

FOREIGN PATENT DOCUMENTS

| | | | |
|---|---|---|---|
| EP | 2899367 | A2 | 7/2015 |
| WO | 2007092082 | A2 | 8/2007 |
| WO | 2008036553 | A2 | 3/2008 |
| WO | 2009061542 | A1 | 5/2009 |
| WO | 2011011306 | A1 | 1/2011 |
| WO | 2017155546 | A1 | 9/2017 |
| WO | 2018187854 | A1 | 10/2018 |
| WO | 2019246501 | A1 | 12/2019 |
| WO | 2020172466 | A1 | 8/2020 |
| WO | 2020206211 | A1 | 10/2020 |
| WO | 2021211664 | A1 | 10/2021 |

OTHER PUBLICATIONS

International Search Report and Written Opinion issued in PCT Application PCT/US2021/027205 dated Jul. 14, 2021 (12 pages).
Combined Search and Examination Report Under Sections 17 and 18(3) issued United Kingdom Patent Application No. GB2216735.8 dated May 13, 2022, 7 pages.
Office Action issued in Azerbaijan Patent Application No. a20210116 dated May 10, 2022, 5 pages with English translation.

* cited by examiner

Run in Hole Wash Down

Set Top Packer

Displace OH

Set Packers

Treat Lower

Reverse Lower

Treat Upper

Reverse Upper

Produce

Closed Open

| Position | System Valves | | | | | |
|---|---|---|---|---|---|---|
| | Return Valve | Reverse Valves | Treat Valves | Isolation Valves | Production Valves | Manara Valves |
| RIH | Closed | Closed | Closed | Open | Closed | Closed |
| Set Top Packer | Closed | Closed | Closed | Open | Closed | Closed |
| Displace OH | Open | Closed | UV Closed, LV Open | UV Closed, LV Open | Closed | UV Closed, LV Open |
| Set Packers | Open | Closed | Closed | Open | Closed | Closed |
| Treat Lower | Open | Closed | UV Closed, LV Open | Closed | Closed | Open |
| Reverse Lower | Open | UV Closed, LV Open | UV Closed, LV Open | Closed | Closed | Closed |
| Treat Upper | Open | Closed | UV Closed, LV Open | UV Closed, LV Open | Closed | UV Closed, LV Open |
| Reverse Upper | Open | UV Closed, LV Open | Closed | Closed | Closed | Closed |
| Produce | Closed | Closed | Closed | Open | Open | Open |

FIG. 3J

Detail C

Detail B

Detail A

Run in Hole

Wash Down/ Displace Hole

Set Top Packer

Drop "Shoe Deactivation Ball" and Set Packers

"Drop Smart Dart" Treat Lower

Reverse Lower

"Drop Smart Dart" Treat Upper

Reverse Upper

Produce Degradable Treatingballs and Profile

Closed Open

| Position | System Valves | | | | | |
|---|---|---|---|---|---|---|
| | Annular Valve | Circulation Reverse | Valve Upper Treat | Circulation Reverse | Valve Lower Treat | Manara Valves |
| RIH | Closed | Closed | Closed | Closed | Closed | Closed |
| Wash Down/ DOH | Closed | Closed | Closed | Closed | Closed | Closed |
| Set Top Packer | Closed | Closed | Closed | Closed | Closed | Closed |
| Set Packers | Closed | Closed | Closed | Closed | Closed | Closed |
| Treat Lower | Open | Closed | Closed | Open | Open | Closed |
| Reverse Lower | Open | Closed | Closed | Open | Closed | Closed |
| Treat Upper | Open | Open | Open | Closed | Closed | Closed |
| Reverse Upper | Open | Open | Closed | Closed | Closed | Closed |
| Produce | Closed | Closed | Closed | Closed | Closed | Open |

FIG. 6J

RIH / Wash Down

Displace OH

Set Packers

Gravel Pack

Reverse Out

Production

| Position | System Valves | | | | |
|---|---|---|---|---|---|
| | Circulating Assembly Valves | | | | |
| | UV (Upper Valve) | BV (Ball Valve) | LV (Lower Valves) | eFCV (electric Flow Control Valve) | STIV (Shunt Tube Isolation Valve) |
| RIH/Washdown | Closed | Open | Closed | Closed | Open |
| Displace OH | Closed | Open | Closed | Only Lower most Valve | Open |
| Set Packers | Closed | Open | Closed | Closed | Open |
| Gravel Pack | Gravel Pack Pos | Closed | Open | All | Open |
| Reverse Out | Reverse Out Pos | Closed | Closed | Closed | Open |
| Production | Closed | Open | Closed | Desired Choke Pos | Closed |

FIG. 9G

SINGLE TRIP WELLBORE COMPLETION SYSTEM

CROSS-REFERENCE TO RELATED APPLICATIONS

The present document is a National Stage of International Application No. PCT/US2021/026104, filed Apr. 7, 2021, which is based on and claims priority to U.S. Provisional Application Ser. No. 63/006,994, filed Apr. 8, 2020, which are incorporated herein by reference in their entirety.

BACKGROUND

The present document is based on and claims priority to U.S. Provisional Application Ser. No. 63/006,994, filed Apr. 8, 2020, which is incorporated herein by reference in its entirety.

Subterranean hydrocarbon services are often necessary to produce hydrocarbons from a subterranean formation. Such services can include, without limitation, perforating operations, completion operations, gravel pack operations, frac pack operations, clean-up operations, flow-back operations, treatment operations, testing operations, production operations, injection operations, and monitor and control operations. Each service is typically performed by running specially designed, service-specific equipment into and out of the wellbore. This is problematic because each trip into and out of the wellbore increases operational risks, rig time, and personnel hours.

While the repetitive steps of running and removing multiple work strings into the well is extremely time consuming and costly, it is even more time consuming and costly to complete boreholes with multiple producing zones within the same formation because each zone is typically completed and produced one at a time. It is highly desirable to complete all zones in a single trip. There is a need, therefore, for new systems and methods that allow the deployment of the entire completion hardware in a single trip for multiple zones.

SUMMARY

In a completion string deployed in a wellbore extending through a plurality of well zones, according to one or more embodiments of the present disclosure, the completion string includes: at least one isolation packer positioned between well zones of the plurality of well zones, the plurality of well zones including: a bottom-most well zone; and a top well zone; a washdown shoe disposed in the bottom-most well zone; a first sand control assembly and a first circulating assembly, each disposed uphole of the washdown shoe in the bottom-most well zone, wherein the top well zone includes a return valve assembly and a production packer, wherein the top well zone further includes a second sand control assembly; and a second circulating assembly, each of the second sand control assembly and the second circulating assembly being downhole of the production packer, wherein the completion string further includes an outer string spanning from the bottom-most well zone to the top well zone; and an inner production string concentrically arranged within the outer string creating an inner-annulus between the outer string and the inner production string, wherein the inner-annulus is continuous from the washdown shoe to the return valve assembly, the inner production string including a first production valve disposed between the first sand control assembly and the first circulating assembly in the bottom-most well zone; and a second production valve disposed between the second sand control assembly and the second circulating assembly in the top well zone.

In a completion string deployed in a wellbore extending through a plurality of well zones according to one or more embodiments of the present disclosure, the completion string includes at least one isolation packer positioned between well zones of the plurality of well zones, the plurality of well zones comprising: a bottom-most well zone; a top well zone; a washdown shoe disposed in the bottom-most well zone; a first sand control assembly and a first circulating assembly, each disposed uphole of the washdown shoe in the bottom-most well zone; an annular flow module and a production packer, each disposed in the top well zone, the top well zone further comprising a second sand control assembly and a second circulating assembly, each disposed downhole of the production packer, wherein the completion string further includes: an outer string spanning from the bottom-most well zone to the top well zone; and an inner production string concentrically arranged within the outer string creating an inner-annulus between the outer string and the inner production string, wherein the inner-annulus is continuous from the washdown shoe in the bottom-most well zone to the annular flow module in the top well zone, wherein the inner-annulus houses a shunt tube system, which facilitates directing flow between well zones of the plurality of well zones, and wherein annular flow above the production packer is directed to the shunt tube system via the annular flow module.

In a completion string deployed in a wellbore extending through a plurality of well zones according to one or more embodiments of the present disclosure, the completion string includes: at least one isolation packer positioned between well zones of the plurality of well zones, the plurality of well zones comprising: a bottom-most well zone; a top well zone; a washdown shoe disposed in the bottom-most well zone; a first sand control assembly disposed uphole of the washdown shoe in the bottom-most well zone, wherein the first sand control assembly cooperates with a first electric flow control valve and a shunt tube isolation valve, each disposed in the bottom-most well zone, wherein the top well zone includes: a circulating assembly; and a production packer adjacent to the circulating assembly, wherein the top well zone further includes a second sand control assembly that cooperates with a second electric flow control valve, and wherein each of the first and second sand control assemblies comprises at least one shunt tube.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 3J shows a truth table of the system valves of the completion string in view of the method shown in FIGS. 3A-3I according to one or more embodiments of the present disclosure;

FIG. 6J shows a truth table of the system valves of the completion string in view of the method shown in FIGS. 6A-6I according to one or more embodiments of the present disclosure;

FIG. 9G shows a truth table of the system valves of the completion in view of the method shown in FIGS. 9A-9F according to one or more embodiments of the present disclosure.

DETAILED DESCRIPTION

Figure 1:
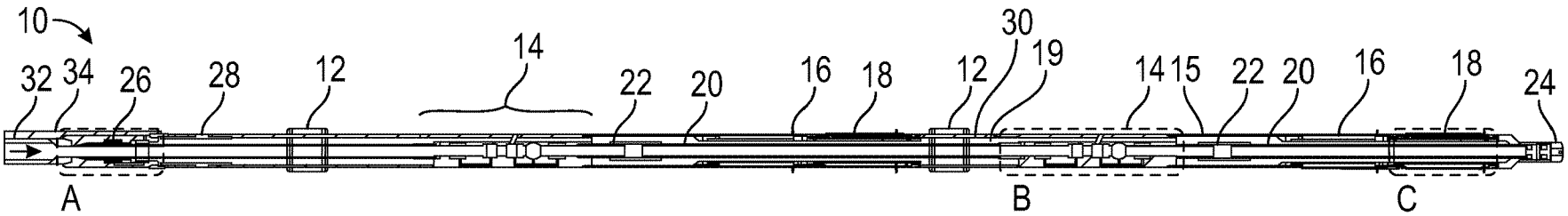
FIG. 1 shows a completion string according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The present disclosure generally relates to a system and method for completing a wellbore. More specifically, the present disclosure relates to a completion string, such as a downhole circulation system, and a method for completing a wellbore requiring stimulation and/or sand control with or without downhole flow control in a single trip.

The completion design according to one or more embodiments of the present disclosure is a single trip gravel pack/frac pack completion string with integrated electrical flow control valves. Advantageously, monitoring of pressure, temperature, and other parameters is possible because the system according to one or more embodiments of the present disclosure allows electric and fiber optic lines to be run through the entire length of the completion string (including the sand face). In a method according to one or more embodiments of the present disclosure, the completion string or downhole circulation system is lowered in the wellbore and hung in the tubing hanger. All completion operations are performed from this position from setting packers until the well is put in production. As another advantage, because the completion design according to one or more embodiments of the present disclosure allows the wellbore to be completed in a single trip, completion installation and gravel packing/frac packing times are reduced, which translates into significant operational cost savings.

FIG. 1-FIG. 3J relate to a completion design for a single trip gravel packing/frac packing completion string with integrated electrical flow control valves according to one or more embodiments of the present disclosure. Because the system allows electric and fiber optic lines to be run through the entire completion length, including the sandface, monitoring of pressure, temperature, and other parameters is possible. In one or more embodiments of the present disclosure, the completion string is lowered in a wellbore, hung in a tubing hanger, and all completion operations are performed from that position from setting packers, until the well is put in production.

The completion string according to one or more embodiments of the present disclosure does not require a service string to perform gravel packing or frac packing operations. Instead, the completion string according to one or more embodiments of the present disclosure is composed of two concentric strings, which coupled with several valves allow for certain required flow paths during the entire completion deployment. For example, fluid communication flow paths provided by the completion design of FIG. 1-FIG. 3J may include an outer annulus between the open hole and screens (i.e., where the gravel is pumped); a micro-annulus between screen wires and non-perforated base pipe (i.e., for the gravel pack fluid dehydration); an inner-annulus between the screen base pipe and inner production string (i.e., for taking return flow); tubing, or the inner diameter (ID) of the inner production string; and an upper-annulus above the production packer, between the casing and the tubing. In one or more embodiments of the present disclosure, the inner-annulus is connected from one zone to the next via a 4-way circulating assembly, which is further described below.

Referring specifically to FIG. 1, a completion string 10 according to one or more embodiments of the present disclosure is shown. In particular, FIG. 1 shows a layout of the completion string 10 with its main components for a two zone completion. As shown in FIG. 1, the completion string 10 may include at least one isolation packer 12 or openhole packer between each well zone, separating two or more well zones. In one or more embodiments of the present disclosure, the at least one isolation packer 12 may include a melting isolating material, such as a metal or resin, for example. The well zones may include at least a bottom-most well zone in an uncased section of a wellbore and a top well zone in the uncased and cased sections of the wellbore. Of note, the completion string 10 according to one or more embodiments of the present disclosure may also operate in an entirely cased wellbore. Moreover, the well zones may also include any number of intermediate well zones between the bottom-most well zone and the top well zone according to one or more embodiments of the present disclosure. Each of the bottom-most well zone and any intermediate well zone includes from top to bottom an openhole or isolation packer 12, a circulating assembly 14, a sand control assembly 16 that includes a pair of screen joints coupled at a screen joint connection, a flow control valve 18 for taking returns, and an inner production string 20 having production valves 22. Moreover, in one or more embodiments of the present disclosure, the bottom-most well zone may include a washdown shoe 24, and the top well zone may include a return valve assembly 26 and a production packer 28 or control line set top packer that is hydraulically set in casing. In one or more embodiments of the present disclosure, the top well zone also includes a circulating assembly 14 and a sand control assembly 16 downhole of the production packer 28. In one or more embodiments of the present disclosure, a sand control assembly 16 and a circulating assembly 14 are disposed uphole of the washdown shoe 24 in the bottom-most well zone. Further, a production valve 22 of the inner production string 20 is disposed between the sand control assembly 16 and the circulating assembly 14 in each of the bottom-most well zone and the top well zone, according to one or more embodiments of the present disclosure.

Still referring to FIG. 1, the production valve 22 according to one or more embodiments of the present disclosure is a one-off opening sleeve that is actuated via a rupture disc. In one or more embodiments of the present disclosure, the actuation command for the production valve 22 may be sent wirelessly via pressure signals, for example, once the well is to be put in production. That is, in one or more embodiments of the present disclosure, the production valve 22 may be remotely actuated via an electrical rupture disc. In other embodiments of the present disclosure, the production valve 22 may be actuated via a mechanical rupture disc. According to one or more embodiments of the present disclosure, the production valve 22 may include an inflow control device. Well suspension may be achieved, prior to opening the at least one production valve 22, upon closing the return valve 26 and once the at least one production valve 22 is opened by closing the return valve 26 and at least the isolation valve 14*c* of the circulating assembly 14 in the top well zone.

As further shown in FIG. 1, the completion string 10 according to one or more embodiments of the present disclosure also includes an outer string 30 spanning from the bottom-most well zone to the top well zone. In one or more embodiments of the present disclosure, the inner production string 20 of the completion string 10 is concentrically arranged within the outer string 30 creating an inner-annulus 19 between the outer string 30 and the inner production string 20. In one or more embodiments of the present disclosure, the separation of well fluids, for example oil from gas, may be achieved by continuing the concentric arrangement of the inner production string 20 within the outer string 30 all the way to surface. According to one or more embodiments of the present disclosure, the inner-annulus 19 is continuous from the washdown shoe 24 to the return valve assembly 26. FIG. 1 also shows that the completion string 10 according to one or more embodiments of the present disclosure may include an electric line 32 or a fiber optic line that runs through the entire length of the completion string 10, including the sand face of the sand control assembly 16 in the bottom-most well zone. In this way, one or more embodiments of the present disclosure provide for an efficient single trip completion string that includes an upper and a lower completion without a need for a wet connection between the upper completion and the lower completion.

Figure 2D:
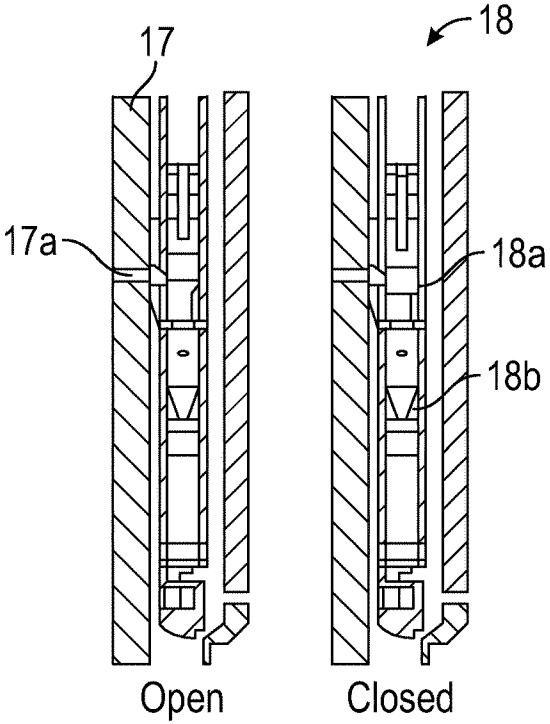
FIG. 2D shows further detail of the downhole flow control valve inside the sand control assembly of FIG. 2C according to one or more embodiments of the present disclosure.
Figure 2C:
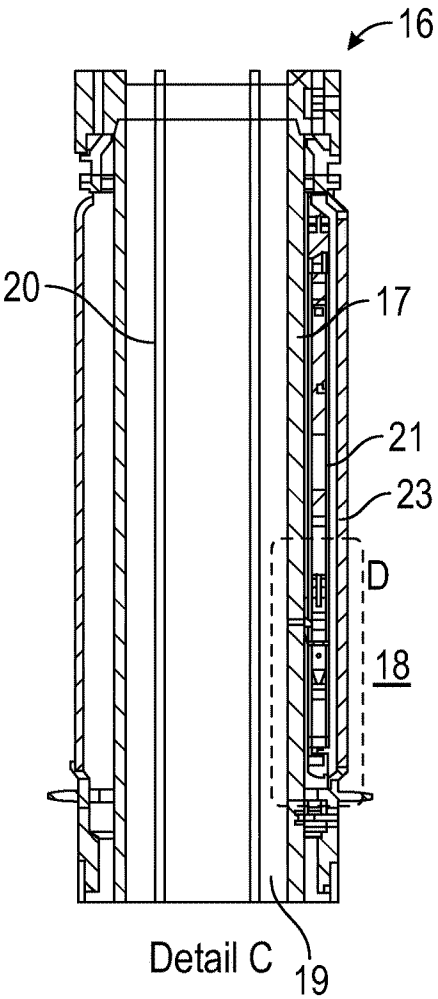
FIG. 2C shows further detail of a downhole flow control valve inside a sand control assembly of the completion string of FIG. 1 according to one or more embodiments of the present disclosure.
Figure 2B:
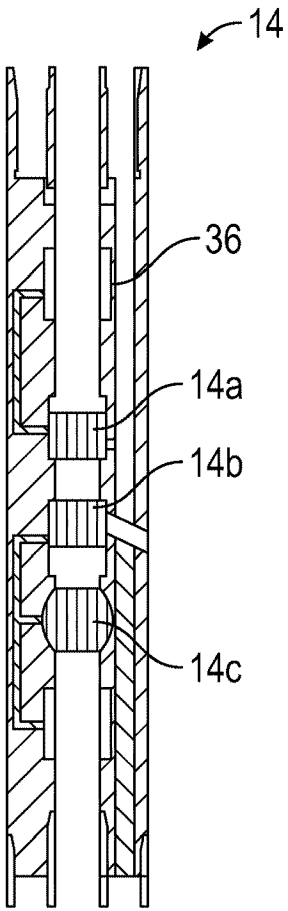
FIG. 2B shows further detail of the circulating assembly of the completion string of FIG. 1 according to one or more embodiments of the present disclosure.
Figure 2A:
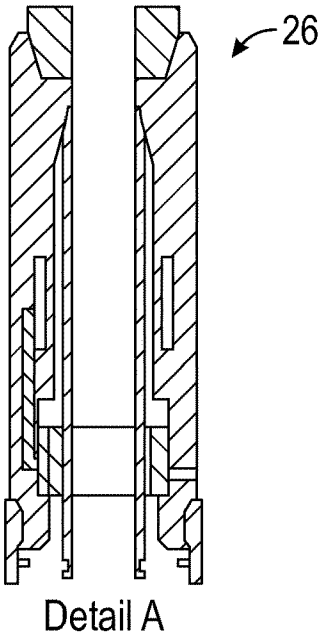
FIG. 2A shows further detail of the return valve of the completion string of FIG. 1 according to one more embodiments of the present disclosure.

Referring now to FIG. 2A, further detail of the return valve 26 of the completion string 10 of FIG. 1 according to one or more embodiments of the present disclosure is shown. The return valve 26 is a remotely operated sliding sleeve type of valve that allows communication between the upper-annulus and the inner-annulus of the production packer 28, according to one or more embodiments of the present disclosure. In one or more embodiments, the return valve 26 may be actuated electrically or hydraulically. Referring to the truth table shown in FIG. 3J, the operational sequence for the return valve 26 requires three actuations in one or more embodiments of the present disclosure: the return valve 26 is in the closed position while the completion string 10 is run-in-hole, the return valve 26 is then opened for treatment and related steps, and the return valve 26 returns to the closed position before production. The return valve 26 may be remotely actuated via an electric rupture disc, according to one or more embodiments of the present disclosure. In such embodiments, the actuation command may be either sent wirelessly via pressure signals, or by using the electric line 32. Alternatively, hydraulic actuations via an open line 34 and a close line is possible.

Referring now to FIG. 2B, further detail of the circulating assembly 14 of the completion string 10 of FIG. 1 according to one or more embodiments of the present disclosure is shown. In one or more embodiments of the present disclosure, the circulating assembly 14, one of the key components of the completion string 10, is adjacent to each well zone. As shown in FIG. 1, in one or more embodiments of the present disclosure, there is one circulating assembly 14 per well zone downhole of the top well zone. In one or more embodiments of the present disclosure, the circulating assembly 14 is composed of 3 valves (e.g., a reverse valve 14*a*, a treat valve 14*b*, and an isolation valve 14*c*) that are controlled via a hydraulic-electric system. Upon reception of a command through the electric line 32, the appropriate valve of the circulating assembly 14 is cycled through the control module 36.

Still referring to FIG. 2B, the circulating assembly 14 according to one or more embodiments of the present disclosure allows for pumping fluid from the inner production string 20 to the outer annulus 25 (i.e., completion outer diameter to formation) via the treat valve 14*b*, from the inner annulus to the inner production string 20 via the reverse valve 14*a*, and inside the inner production string 20 or to isolate the completion string 10 below via the isolation valve 14*c*. Advantageously, the 4-way connections of the circulating assembly 14 according to one or more embodiments of the present disclosure facilitate connection from one well zone to the next while preserving the inner annulus through the length of the completion string 10.

Referring now to FIG. 2C, further detail of a flow control valve 18 inside the sand control assembly 16 of the completion string 10 of FIG. 1 is shown according to one or more embodiments of the present disclosure. Specifically, the flow control valve 18 may be a Schlumberger Manara valve, and the sand control assembly 16 may be a Schlumberger MZ-Xpress screen, according to one or more embodiments of the present disclosure. Further, in one or more embodiments of the present disclosure, the sand control assembly 16 may be alternate path compatible for gravel packing applications. Moreover, the flow control valve 18 may be a full bore electric flow control valve, according to one or more embodiments of the present disclosure.

Referring to FIGS. 1 and 2C, in one or more embodiments of the present disclosure, the sand control assembly 16 includes a pair of screen joints coupled at a screen joint connection. Moreover, each screen joint of the sand control assembly 16 according to one or more embodiments of the present disclosure includes a non-perforated base pipe 17, a filter medium 23 such as a screen disposed around the non-perforated base pipe 17, and a micro-annulus 21 between the filter medium 23 and the non-perforated base pipe 17. The sand control assembly 16 according to one or more embodiments of the present disclosure is unique at least because the micro-annulus 21 is continuous from screen joint to screen joint. In one or more embodiments of the present disclosure, the outer string 30 of the completion string 10 includes the non-perforated base pipe 17 of each screen joint and additional blank pipe 15. Moreover, the sand control assembly 16 according to one or more embodiments of the present disclosure includes a feedthrough for the electric line 32 of the completion string 10.

In embodiments of the present disclosure where there is at least one intermediate well zone between the bottom-most well zone and the top well zone, the completion string 10 may include an additional sand control assembly 16 and an additional circulating assembly 14 disposed in the at least one intermediate well zone. Moreover, in embodiments of the present disclosure having at least one intermediate well zone, the inner production string 20 may include an additional production valve 22 disposed between the sand control assembly 16 and the circulating assembly 14 in the at least one intermediate well zone.

Referring to FIGS. 1, 2C, and 2D, which show further detail of the downhole flow control valve 18 in cooperation with the sand control assembly 16 of FIG. 2C according to one or more embodiments of the present disclosure, the filter medium 23 of the sand control assembly 16 is offset from the base pipe 17 through high standoff rib wires, which allow for the placement of the flow control valve 18 (based off the Manara Valve tube). Integrating the sand control assembly 16 and the flow control valve 18 in each of the well zones in this way allows for optimized production. As shown in FIG. 2D, for example, the flow control valve 18 may include a plunger 18*a* and a venturi valve 18*b* in one or more embodiments of the present disclosure. As further shown in FIG. 2D, in an open configuration, the plunger 18*a* of the flow control valve 18 is offset from a port 17*a* in the base pipe 17 of the sand control assembly 16, the port 17*a* allowing flow to the inner-annulus 19 between the base pipe 17 and the inner production string 20. FIG. 2D also shows that the plunger 18*a* of the flow control valve 18 shifts to obstruct the port 17*a* of the base pipe 17 so that no fluid may flow into the inner-annulus 19 in the closed configuration.

Still referring to FIGS. 1 and 2D, the system is modular as it allows one or multiple flow control valves 18 to be used in a given well zone. At a minimum, one flow control valve 18 cooperates with the sand control assembly 16 to allow for selective production and effective gravel pack placement in one or more embodiments of the present disclosure. In one or more embodiments of the present disclosure, the flow control valve 18 may be positioned inside the filter medium 23 (i.e., inside the micro-annulus 21 of the screen joint) as shown in FIGS. 2C-2D, or the flow control valve 18 may be positioned at a location next to the screen joint that is external to the micro-annulus 21 and the corresponding filter medium 23 (not shown). Moreover, the flow control valve 18 according to one or more embodiments of the present disclosure may be positioned above or below a screen joint of the sand control assembly 16. An inflow control device may be positioned in the flow control valve 18 according to one or more embodiments of the present disclosure.

Figure 3A:
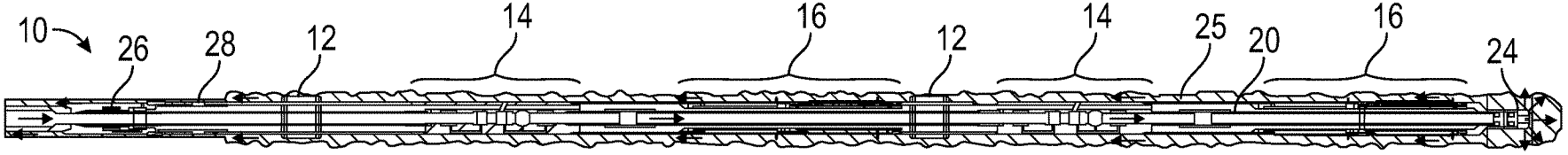
FIGS. 3A-3I show a method of completing a wellbore in a single trip according to one or more embodiments of the present disclosure.

Referring now to FIGS. 3A-3I, a method of completing a wellbore in a single trip according to one or more embodiments of the present disclosure is shown. After making up all of the completion assemblies at the rotary, the completion string 10 may be deployed into the wellbore as shown in FIG. 3A in a method according to one or more embodiments of the present disclosure. As further shown in FIG. 3A, in one or more embodiments of the present disclosure, fluid may be pumped through the inner production string 20, down to and out of the washdown shoe 24 in bottom-most well zone, and into the outer annulus 25. In preparation for subsequent treatment operations, the fluid cleans the outer annulus 25 as the fluid returns to the surface. Referring now to FIG. 3J, while the completion string 10 is run-in-hole and during washdown as shown in FIG. 3A, all system valves of the completion string 10 are closed except for the isolation valves 14*c* of the circulating assemblies 14. Setting the system valves of the completion string 10 in this way facilitates pumping fluid from the tubing through the completion inner diameter (i.e., the inner production string 20) to the washdown shoe 24 and back to the completion annulus to surface. The open hole fluid can be displaced in that same position (i.e., tubing to annulus). To allow adequate fluid filling while running in hole, the return valve 26 and the reverse valves 14*a* of the circulating assemblies 14 may be cycled in the open position according to one or more embodiments of the present disclosure.

Figure 3B:
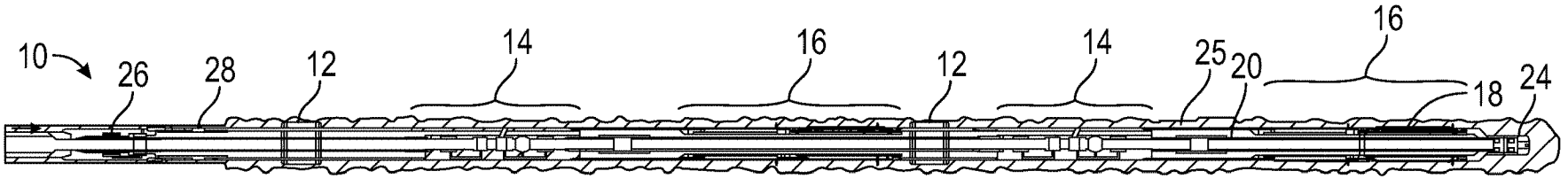

As shown in FIG. 3B, the method further includes setting the production packer 28 in one or more embodiments of the present disclosure. The production packer 28 is set via a hydraulic line 34 or electric line 32 according to one or more embodiments of the present disclosure. As shown in FIG. 3J, for example, when the production packer 28 is set, system valves of the completion string 10 are closed except for the isolation valves 14*c* of the circulating assemblies 14.

Figure 3C:
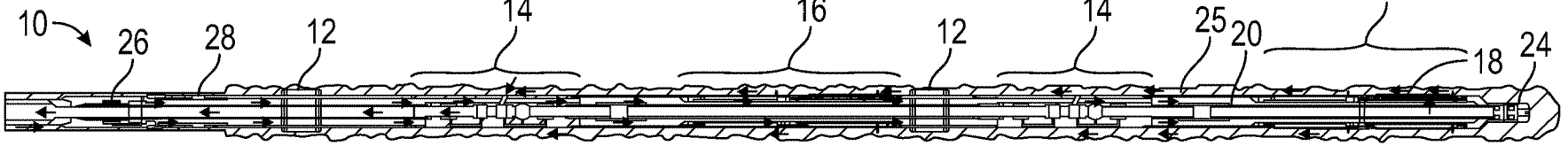

Referring now to FIG. 3C, the method further includes pumping displacement fluid through the completion string 10 in an annulus-to-tubing direction. Advantageously, displacing the open hole in the annulus-to-tubing direction helps protect the screens 23 of the sand control assembly 16. As shown in FIG. 3J, in this position, the return valve 26 is open, the top-most treat valve 14*b* of the top circulating assembly 14 is open, and the bottom-most flow control valve 18 is open. Also, in this position, the upper isolation valve 14*c* of the circulating assembly 14 is closed. In other embodiments of the present disclosure, displacement fluid may be pumped through the completion string 10 in a tubing-to-annulus direction.

Figure 3D:
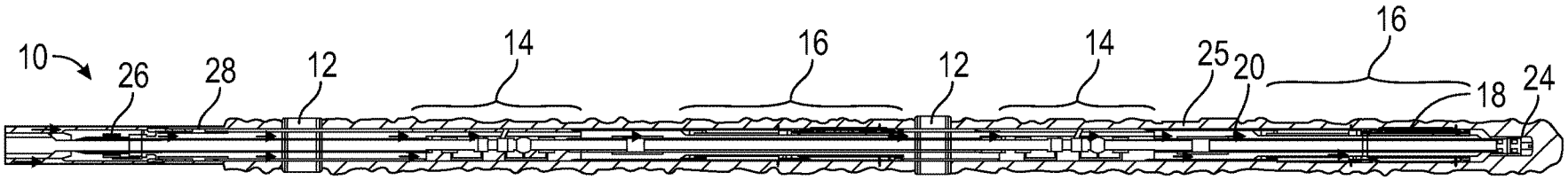

Referring now to FIG. 3D, the method further includes setting the at least one isolation packer 12. In one or more embodiments of the present disclosure, the at least one isolation packer 12 may be set hydraulically. For hydraulic setting of the at least one isolation packer 12, pressure is conveyed to the setting section by pressuring the tubing annulus and opening the return valve 26, all other system valves of the completion string 10 will remain closed except for the isolation valves 14*c* of the circulating assemblies 14.

In other embodiments of the present disclosure, the at least one isolation packer 12 may be set electrically, such as by an eFire or eTrigger that is actuated via the electric line 32, for example. According to one or more embodiments of the present disclosure, the plurality of isolation packers 12 in the completion string may be set simultaneously.

Figure 3E:
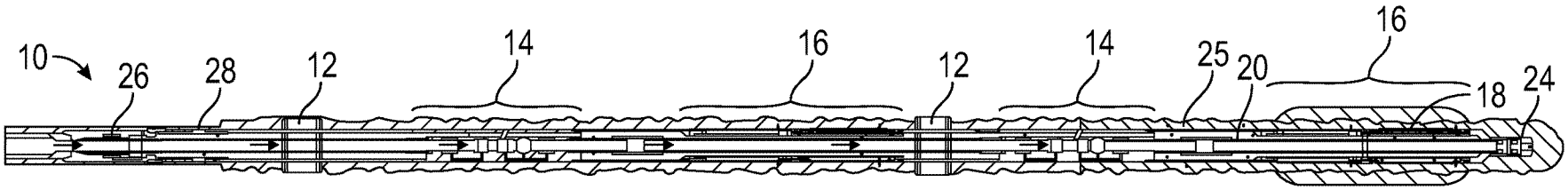

Referring now to FIG. 3E, the method further includes treating the bottom-most well zone. In one or more embodiments of the present disclosure, treating the bottom-most well zone includes performing fracturing and gravel pack operations. In one or more embodiments, an annulus blowout preventer will be closed on the tubing, and treatment fluid is pumped down the inner production string 20, out to the open hole through the treat valve 14*b* of the lower circulating assembly 14, to the flow control valve 18 in the bottom-most well zone, up the inner string annulus 19, and through the return valve 26 to surface. In one or more embodiments of the present disclosure, during this treating step, the lower isolation valve 14*c* of the circulating assembly 14 is closed, the lower treat valve 14*b* of the circulating assembly 14 is open, and the flow control valve 18 is open, as shown in FIG. 3J, for example.

Figure 3F:
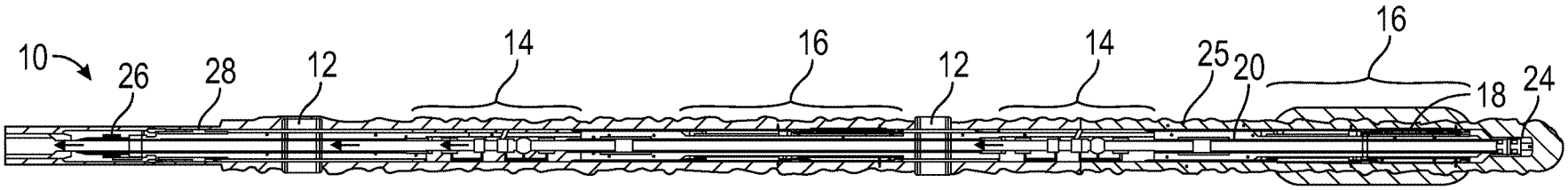

Referring now to FIG. 3F, the method further includes reversing out the bottom-most well zone. In one or more embodiments of the present disclosure, this step enables reversing out the excess slurry that remains in the tubing following the gravel pack and fracturing treatments. As shown in FIG. 3J, during this reversing out step, the isolation valve 14*c* of the lower circulating assembly is closed, and the lower reverse valve 14*a* of the circulating assembly 14 is opened. In this position, fluid can be pumped from the tubing annulus through the return valve 26 and lower reverse valves 14*a* back to the inner production string 20 and then the tubing. The formation is isolated via the isolation valve 14*c* and treat valve 14*b* of the circulating assembly 14 and the bottom-most flow control valve 18.

Figure 3G:
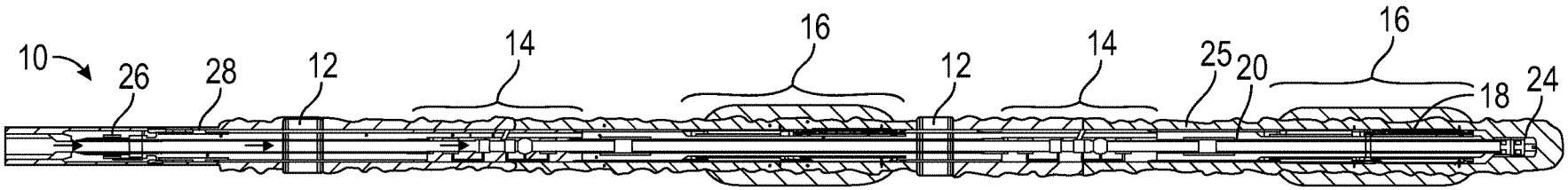
Figure 3H:
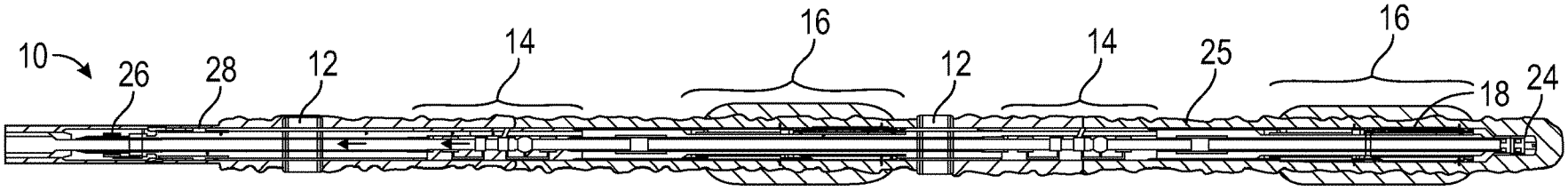
Figure 3I:
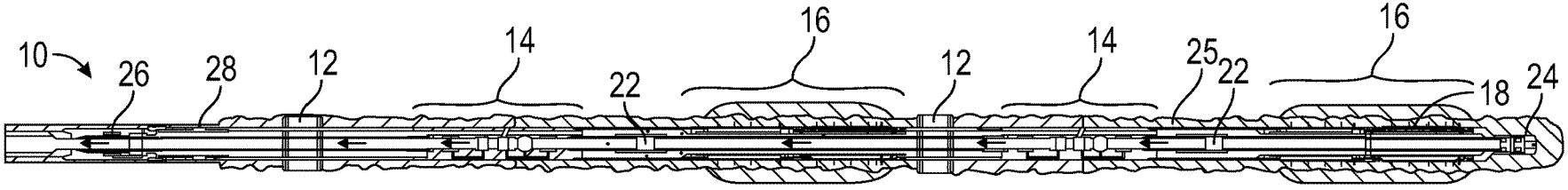

Referring now to FIGS. 3G and 3H, the method further includes treating and reversing out the top well zone. In one or more embodiments of the present disclosure, the operation continues with steps identical to those shown in FIGS. 3E and 3F with the lower circulating assembly 14 fully closed and the lower flow control valve 18 fully closed, as shown in FIG. 3J, for example. That is, in the method according to one or more embodiments of the present disclosure, open hole or closed hole gravel packing/frac packing treatment operations and subsequent reverse out operations may be performed for a given zone, for each zone to be completed.

Referring now to FIG. 31, the method further includes putting the well in production by opening the production valves 22 in the completion string 10 to allow production fluid inside the inner production string 20 to be produced at surface. During this step of the method, as shown in FIG. 3J, the flow control valves 18 are opened, and the opening of the flow control valves 18 may be controlled to regulate the reservoir flow. As further shown in FIG. 3J, the production valves 22 are opened to allow fluid inside the inner production string 20, and the isolation valves 14*c* of the circulating assemblies 14 are opened.

FIG. 4-FIG. 6J relate to a completion design for a single trip gravel packing/frac packing completion string with integrated electrical flow control valves and a shunt tube system that facilitates directing flow between well zones of the plurality of well zones according to one or more embodiments of the present disclosure. Because the system allows electric and fiber optic lines to be run through the entire completion length, including the sandface, monitoring of pressure, temperature, and other parameters is possible. In one or more embodiments of the present disclosure, the completion string is lowered in a wellbore, hung in a tubing hanger, and all completion operations are performed from that position from setting packers, until the well is put in production.

The completion string 10 according to one or more embodiments of the present disclosure does not require a service string to perform gravel packing or frac packing operations. Instead, the completion string 10 according to one or more embodiments of the present disclosure includes an inner concentric string, i.e., the inner production string 20, connected to the base pipe 17 of the sand control assembly 16. Further, in the completion string 10 according to one or more embodiments of the present disclosure, the concentric annulus (or inner-annulus 19) flows are distributed with an internal shunt tube system 38 along the completion string 10. For example, fluid communication flow paths provided by the completion design of FIG. 4-FIG. 6J may include an outer annulus between the open hole and screens (i.e., where the gravel is pumped); a micro-annulus between screen wires and non-perforated base pipe (i.e., for the gravel pack fluid dehydration); a shunt return tube placed adjacent to each well zone that allows fluid dehydration during gravel packing up to an annular flow module; an inner-annulus between the screen base pipe and inner production string, the inner-annulus housing a shunt tube manifold system that allows for directing flow from one zone to the next; tubing, or the ID of the inner production string, which is connected to the base pipe of the sand control assembly; and an upper-annulus above the production packer, between the casing and the tubing. In one or more embodiments of the present disclosure, the inner-annulus is connected from one zone to the next via a 4-way circulating assembly, which is further described below. Moreover, in one or more embodiments of the present disclosure, the inner-annulus is continuous from the washdown shoe 24 to the annular flow module 44 through the lower completion portion of the completion string 10.

Figure 4:
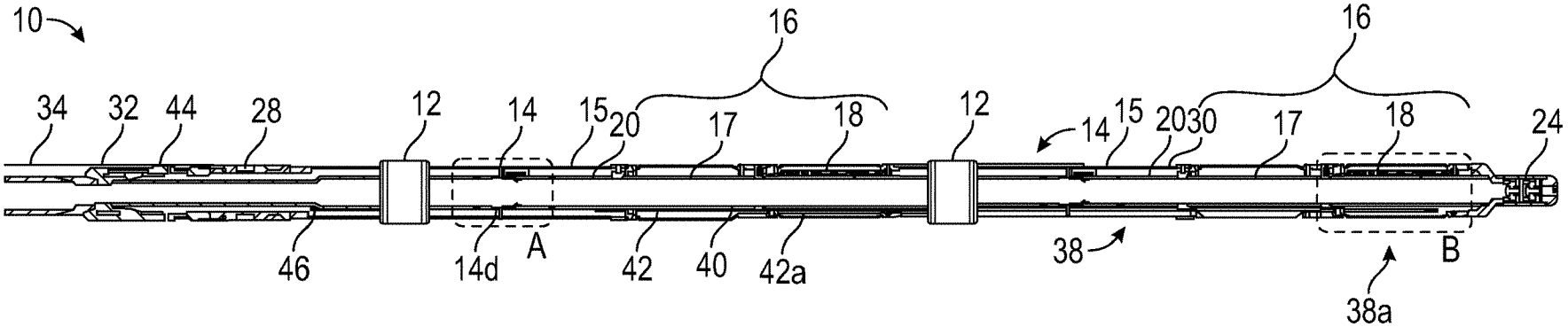
FIG. 4 shows a completion string according to one or more embodiments of the present disclosure.

Referring to specifically to FIG. 4, a completion string 10 according to one or more embodiments of the present disclosure is shown. In particular, FIG. 4 shows a layout of the completion string 10 with its main components for a two zone completion. As shown in FIG. 4, the completion string 10 may include at least one isolation packer 12 or open hole packer between a plurality of well zones, including a bottom-most well zone in the uncased section of the wellbore, a top well zone in the cased section of the wellbore, and at least one intermediate well zone in the uncased section of the wellbore between the bottom-most well zone and the top well zone. Of note, the completion string 10 according to one or more embodiments of the present disclosure may also operate in an entirely cased wellbore. In one or more embodiments of the present disclosure, the at least one isolation packer 12 may include a melting isolating material, such as a metal or resin, for example. Each of the bottom-most well zone and any intermediate well zone includes from top to bottom an openhole or isolation packer 12, a circulating assembly 14, blank pipe 15, a sand control assembly 16 that includes a pair of screen joints coupled at a screen joint connection, a flow control valve 18 for taking returns, an inner production string 20 continuous with the base pipe 17, and a shunt tube system 38 having a reverse tube 40 and a return tube 42. Moreover, in one or more embodiments of the present disclosure, the bottom-most well zone may include a washdown shoe 24, and the top well zone may include an annular flow module 44 and a production packer 28 or control line set top packer that is hydraulically set in casing. In one or more embodiments of the present disclosure, a sand control assembly 16 and a circulating assembly 14 are disposed uphole of the washdown shoe 24 in the bottom-most well zone. Further, a sand control assembly 16 and a circulating assembly 14 may be disposed downhole of the production packer 28 in the top well zone.

As further shown in FIG. 4, the completion string 10 according to one or more embodiments of the present disclosure also includes an outer string 30 spanning from the bottom-most well zone to the top well zone. In one or more embodiments of the present disclosure, the inner production string 20 of the completion string 10 is concentrically arranged within the outer string 30 creating an inner-annulus between the outer string 30 and the inner production string 20. In one or more embodiments of the present disclosure, the separation of well fluids, for example oil from gas, may be achieved by continuing the concentric arrangement of the inner production string 10 within the outer string 30 all the way to surface. According to one or more embodiments of the present disclosure, the inner-annulus is continuous from the washdown shoe 24 in the bottom-most well zone to the annular flow module 44 in the top well zone. In one or more embodiments of the present disclosure, the inner-annulus houses a shunt tube system 38, which facilitates directing flow between well zones. Moreover, annular flow above the production packer 28 is directed to the shunt tube system 38 via the annular flow module 44.

According to one or more embodiments of the present disclosure, in the concentric annulus, the shunt tube system 38 splits annular flow according to the following principles. For example, the shunt tube system 38 includes a common annular tube 46 disposed in the top well zone of the inner-annulus of the completion string 10. In one or more embodiments of the present disclosure, the common annular tube 46 splits for each well zone into a common return tube 42 and a common reverse tube 40. In one or more embodiments, it is possible to include several common annular tubes 46 along the circumference. In other embodiments of the present disclosure, the shunt tube system 38 may include dedicated return and reverse tubes instead of a common annular tube that splits without departing from the scope of the present disclosure. As shown in FIG. 4, the common reverse tube 40 is connected to a reverse port 14*d* of each circulating assembly 14, according to one or more embodiments of the present disclosure. As further described below, the reverse port 14*d* is opened via a ball or smart dart. A check valve in the reverse tube 40 allows only for downward flow. As also shown in FIG. 4, the common return tube 42 splits at a top of the bottom-most screen joint of a given well zone into a ported return tube 42*a*, according to one or more embodiments of the present disclosure. A check valve inside each of the tubes of the split common return tube 42 allows only upward flow, according to one or more embodiments of the present disclosure.

FIG. 4 also shows that the completion string 10 according to one or more embodiments of the present disclosure may include an electric line 32 and/or a fiber optic line that runs through the completion string 10 at least from the top well zone to the circulating assembly 14 in the bottom-most well zone. In this way, one or more embodiments of the present disclosure provide for an efficient single trip completion string that includes an upper and a lower completion without a need for a wet connection between the upper completion and the lower completion.

Figure 5C:
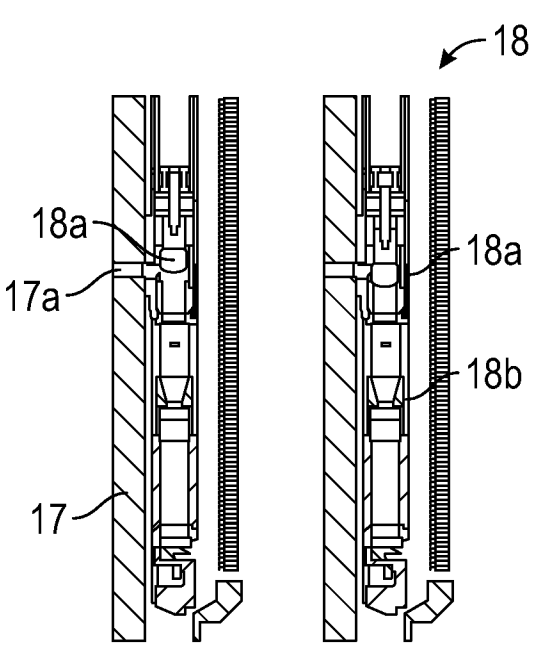
FIG. 5C shows further detail of the shunt tube return section of FIG. 5B according to one or more embodiments of the present disclosure.
Figure 5B:
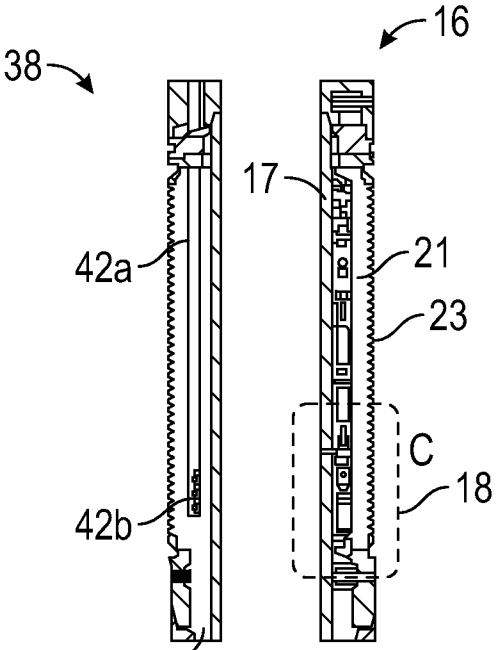
FIG. 5B shows further detail of a shunt tube return section of the completion string of FIG. 4 according to one or more embodiments of the present disclosure.
Figure 5A:
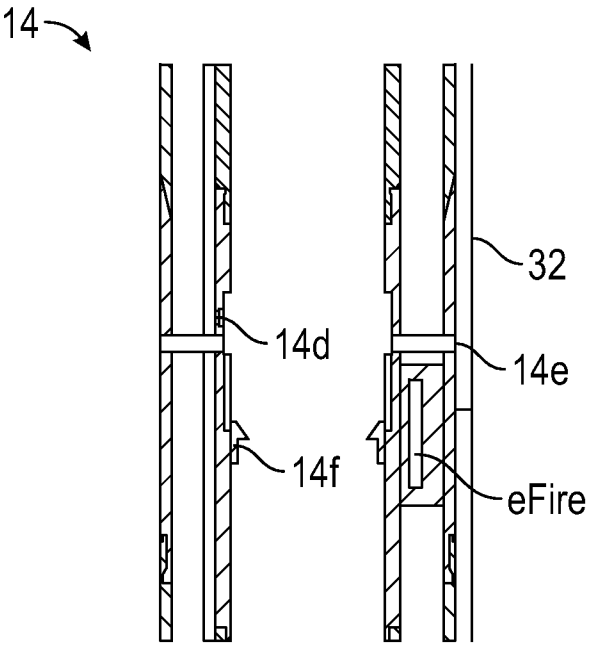
FIG. 5A shows further detail of the circulating assembly of the completion string of FIG. 4 according to one or more embodiments of the present disclosure.

Referring now to FIG. 5A, further detail of the circulating assembly 14 of the completion string 10 of FIG. 4 according to one or more embodiments of the present disclosure is shown. In one or more embodiments of the present disclosure, the circulating assembly 14 of FIG. 5A is a 4-way connecting system, such as that previously described. However, the circulating assembly 14 of FIG. 5A is a three-position valve in one or more embodiments of the present disclosure. As shown in FIG. 5A, the circulating assembly 14 according to one or more embodiments of the present disclosure may include a treating port 14*e*, a reverse port 14*d*, and a degradable profile or seat 14*f* In a treat position of the circulating assembly 14, the circulating assembly 14 is fully opened with the treating port 14*e* open and the reverse port 14*d* open. According to one or more embodiments of the present disclosure, the reverse port 14*d* and the treating port 14*e* are configured to open when the dart lands in the seat 14*f*. Moreover, in the treat position, a check valve associated with the reverse port 14*d* facilitates isolation by only allowing for downward flow. In a reverse position of the circulating assembly 14, the treating port 14*e* closes while the reverse port 14*d* remains open. In a closed position of the circulating assembly 14, the circulating assembly 14 is fully closed with the treating port 14*e* and the reverse port 14*d* being isolated by a sleeve of the circulating assembly 14. According to one or more embodiments of the present disclosure, the sleeve of the circulating assembly 14 is shifted by a dedicated ball or smart dart. Dedicated balls or darts would result in stage decreasing ID, as commonly used in multi-stage systems. In one or more embodiments of the present disclosure, the ball/dart and seat 14*f* of the circulating assembly 14 would degrade over time. In other embodiments of the present disclosure, the ball/dart would activate only in its dedicated profile without any ID reduction. In such embodiments, the seat profile 14*f* of the circulating assembly 14 may or may not be degradable; however, the ball/dart would need to be milled out post operation. In one or more embodiments of the present disclosure, the circulating assembly 14 is controlled via a hydraulic-electric system.

Referring now to FIG. 5B, further detail of a flow control valve 18 inside the sand control assembly 16 of the completion string 10 of FIG. 4 is shown according to one or more embodiments of the present disclosure. Specifically, the flow control valve 18 may be a Schlumberger Manara valve, and the sand control assembly 16 may be a Schlumberger MZ-Xpress screen, according to one or more embodiments of the present disclosure. Further, in one or more embodiments of the present disclosure, the sand control assembly 16 may be alternate path compatible for gravel packing applications. Moreover, the flow control valve 18 may be a full bore electric flow control valve, according to one or more embodiments of the present disclosure. In one or more embodiments of the present disclosure, the flow control valve 18 may be positioned inside the filter medium 23 (i.e., inside the micro-annulus 21 of the screen joint) as shown in FIGS. 5B-5C, or the flow control valve 18 may be positioned at a location next to the screen joint that is external to the micro-annulus 21 and the corresponding filter medium 23 (not shown). Moreover, the flow control valve 18 according to one or more embodiments of the present disclosure may be positioned above or below a screen joint of the sand control assembly 16. An inflow control device may be positioned in the flow control valve 18 according to one or more embodiments of the present disclosure.

Referring to FIGS. 4 and 5B, in one or more embodiments of the present disclosure, the sand control assembly 16 includes a pair of screen joints coupled at a screen joint connection. Moreover, each screen joint of the sand control assembly 16 according to one or more embodiments of the present disclosure includes a non-perforated base pipe 17, a filter medium 23 such as a screen disposed around the non-perforated base pipe 17, and a micro-annulus 21 between the filter medium 23 and the non-perforated base pipe 17. The sand control assembly 16 according to one or more embodiments of the present disclosure is unique at least because the micro-annulus 21 is continuous from screen joint to screen joint. That is, the micro-annulus 21 according to one or more embodiments of the present disclosure is continuous through the given sand control assembly 16 of the given well zone. As further shown in FIGS. 4 and 5B, the flow control valve 18 as previously described may be positioned in the micro-annulus 21 of the bottom-most screen joint in one or more embodiments of the present disclosure. In other embodiments, the flow control valve 18 may be positioned outside the filter medium 23, as previously described. Moreover, the flow control valve 18 may be positioned next to or within one of the screen joints according to one or more embodiments of the present disclosure. As further shown in FIG. 4, the inner production string 20 is continuous with the non-perforated base pipe 17 of the sand control assembly 16.

Referring to FIG. 5B, further detail of the return section of the shunt tube system 38 of the completion string 10 of FIG. 4 is shown according to one or more embodiments of the present disclosure. As shown in FIG. 5B, the return section of the shunt tube system 38, which may include a return tube 42*a* and at least one return port 42*b*, is disposed in the micro-annulus 21 between the filter/screen 23 and the non-perforated base pipe 17.

Referring to FIGS. 4, 5B, and 5C, which show further detail of the downhole flow control valve 18 in cooperation with the sand control assembly 16 according to one or more embodiments of the present disclosure, the filter medium 23 of the sand control assembly 16 is offset from the base pipe 17 through high standoff rib wires, which allow for the placement of the flow control valve 18 (based off the Schlumberger Manara valve tube). Integrating the sand control assembly 16 and the flow control valve 18 in each of the bottom-most and intermediate well zones in this way allows for optimized production. As shown in FIG. 5C, for example, the flow control valve 18 may include a plunger 18*a* and a venturi valve 18*b* in one or more embodiments of the present disclosure. As further shown in FIG. 5C, in an open configuration, the plunger 18*a* of the flow control valve 18 is offset from a port 17*a* in the base pipe 17 of the sand control assembly 16, the port 17*a* allowing flow into the inner production string 20. FIG. 5C also shows that the plunger 18*a* of the flow control valve 18 shifts to obstruct the port 17*a* of the base pipe 17 so that no fluid may flow into the inner production string 20 in the closed configuration.

Referring back to FIG. 4, in one or more embodiments of the present disclosure, the at least one isolation (or open hole) packer 12 is set with hydraulic pressure when the annular flow module 44 is opened and applied inside the concentric annulus of the completion string 10. The isolation packer 12 according to one or more embodiments of the present disclosure may be based off of an expandable steel annular zonal isolation packer, such as the Saltel AZIP, and may be rated up to 15 k psi, for example. According to one or more embodiments of the present disclosure, the isolation packer 12 includes a mandrel that is modified to allow bypass of the electric line 32, shunts of the shunt tube system 38, and annular flow, as shown in FIG. 4, for example. Setting ports of the isolation packer 12 are positioned in a plane offset from the concentric annulus of the completion string 10 and drilled radially in one or more embodiments of the present disclosure. In this way, the design of isolation packer 12 according to one or more embodiments of the present disclosure is similar to that of a regular crossover port body, or to the radial configuration of aforementioned circulation assemblies 14. According to one or more embodiments of the present disclosure, an additional isolation packer 12 may be added between the washdown shoe 24 and the bottom-most screen joint to allow for a balanced fracturing operation.

Figure 6A:
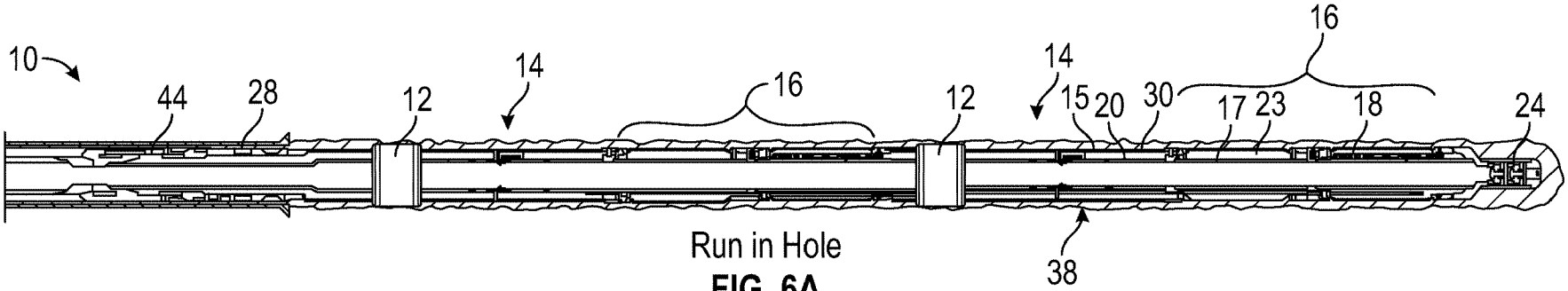
FIGS. 6A-6I show a method of completing a wellbore in a single trip according to one or more embodiments of the present disclosure.

Referring now to FIGS. 6A-6J, a method of completing a wellbore in a single trip according to one or more embodiments of the present disclosure is shown. After making up all of the completion assemblies at the rotary, the completion string 10 may be deployed into the wellbore as shown in FIG. 6A in a method according to one or more embodiments of the present disclosure. As shown in FIG. 6J, while the completion string 10 is run-in-hole, all system valves of the completion string 10 are closed. As shown in FIG. 6A, while running in hole, the completion string 10 fills through the screens 23 of the sand control assembly 16 and ported shunts of the shunt tube system 38. In one or more embodiments of the present disclosure, the annular flow module 44, the flow control valves 18, and the circulating assemblies are closed while the completion string 10 is run in hole. In one or more embodiments, this configuration allows fluid to be pumped from the tubing through the inner production string 20 to the washdown shoe 24 and back to the completion annulus to surface.

Figure 6B:
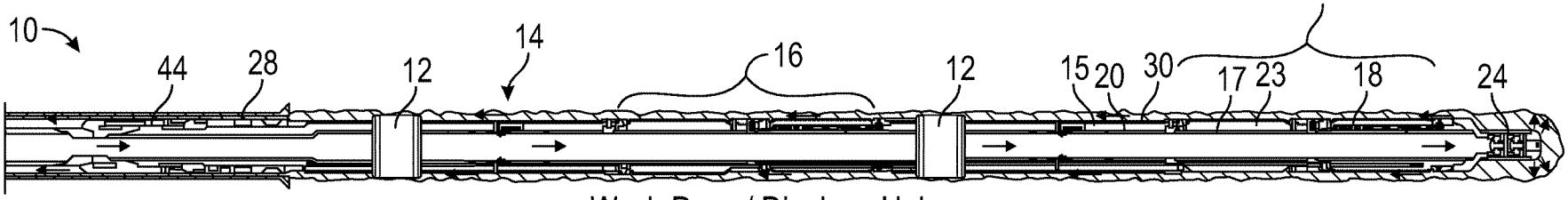

As shown in FIG. 6B, the method further includes pumping displacement fluid through the inner production string 20, through the washdown shoe 24, and back to surface via an outer annulus between the uncased section of the wellbore and the screens 23 of the sand control assemblies 16 in one or more embodiments of the present disclosure. This pumping displacement fluid step of the method according to one or more embodiments of the present disclosure may occur while the completion string is running in hole. As such, the system valves of the completion string 10 may assume the same configuration as previously described with respect to the run in hole step, as the displacement fluid flows in a tubing-to-annulus direction through the completion string 10.

Figure 6C:
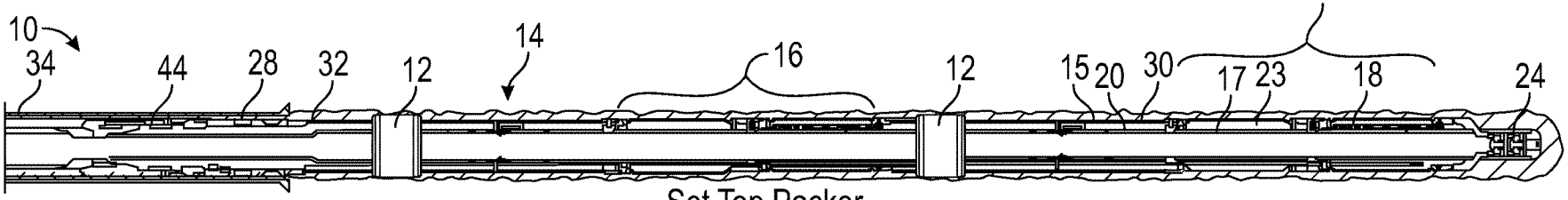

As shown in FIG. 6C, the method further includes setting the production packer 28 in one or more embodiments of the present disclosure. The production packer 28 is set via a hydraulic line 34 or electric line 32 according to one or more embodiments of the present disclosure. As shown in FIG. 6J, for example, when the production packer 28 is set, all system valves of the completion string 10 are closed.

Figure 6D:
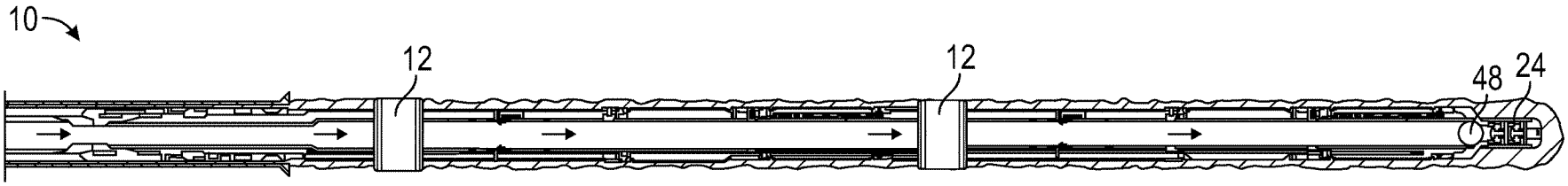

As shown in FIG. 6D, the method further includes dropping a washdown shoe 24 deactivation mechanism 48 to set the at least one isolation packer 12 in one or more embodiments of the present disclosure. In one or more embodiments of the present disclosure, the deactivation mechanism 48 may be a ball, a dart, a plug, or any mechanism that is capable of obstructing the washdown shoe 24. According to one or more embodiments of the present disclosure, all isolation packers 12 of the completion string 10 may be set simultaneously. In this step of the method according to one or more embodiments of the present disclosure, the at least one isolation packer 12 is hydraulically set, and pressure is conveyed to the setting section be pressuring the tubing against the deactivation mechanism 48 set in the washdown shoe 24 of the completion string. As shown in FIG. 6J, for example, when the at least one isolation packer 12 is set, all system valves of the completion string 10 are closed.

Figure 6E:
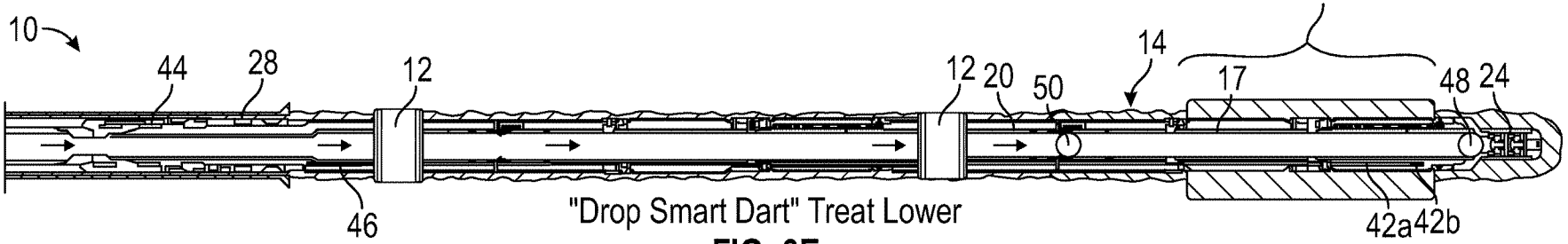

As further shown in FIG. 6E, the method further includes dropping a dart or ball 50 in the seat 14*f* of the circulating assembly 14 of the lower completion, and treating the bottom-most well zone. In one or more embodiments of the present disclosure, treating the bottom-most well zone includes performing fracturing and gravel pack operations. Dropping the dart or ball 50 in the seat 14*f* of the circulating assembly 14 of the lower completion opens the treating port 14*e* and the reverse port 14*d* of the circulating assembly 14, as shown in FIG. 6J, for example. During this step of the method according to one or more embodiments of the present disclosure, the annular blowout preventer will be closed on the tubing, and treatment fluid is pumped down the inner production string 20 and out to the outer annulus of the completion string 10 through the treating port 14*e* of the lower circulating assembly 14, through the screen jacket in between the screen jacket and the base pipe 17 to the return tube ports 42*b*, up the return tube 42*a*, up the inner string annulus, out the common annular tube 46, and through the annular flow module 44 to the surface. Indeed, as shown in FIG. 6J, the annular valve of the annular flow module 44 is open during this treating step according to one or more embodiments of the present disclosure.

Figure 6F:
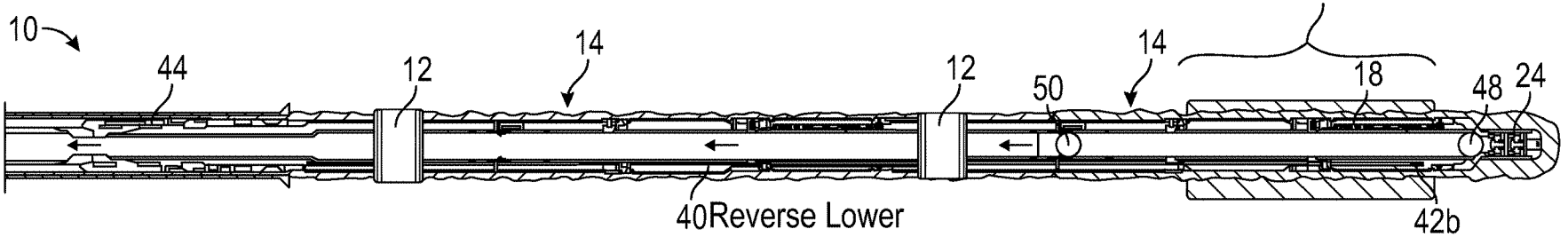

Referring now to FIG. 6F, the method further includes reversing out the bottom-most well zone according to one or more embodiments of the present disclosure. In one or more embodiments of the present disclosure, this step enables reversing out the excess slurry that remains in the tubing following the gravel pack and fracturing treatments. As shown in FIG. 6J, during this reversing out step, the treating port 14*e* of the circulating assembly 14 is closed via pressure pulse or electric signal. In this position, fluid can be pumped from the tubing annulus through the annular flow valve of the annular flow module 44 to the reverse tube 40 to the reverse port 14*d* back to the inner production string 20 and then the tubing. The formation is isolated via check valves of the shunt tube system 38 and the bottom-most flow control valve 18. In one or more embodiments of the present disclosure, once the reverse operation is completed, another signal is sent, and the circulating assembly 14 is fully closed.

Figure 6G:
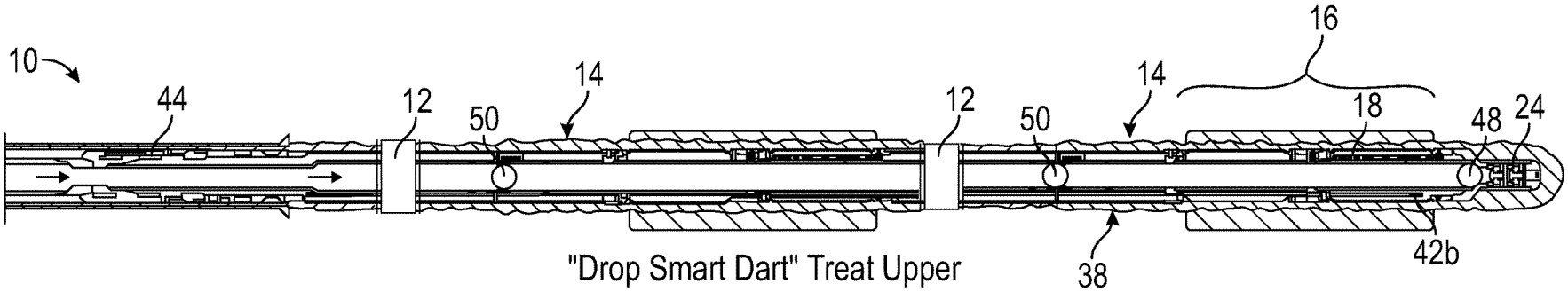
Figure 6H:
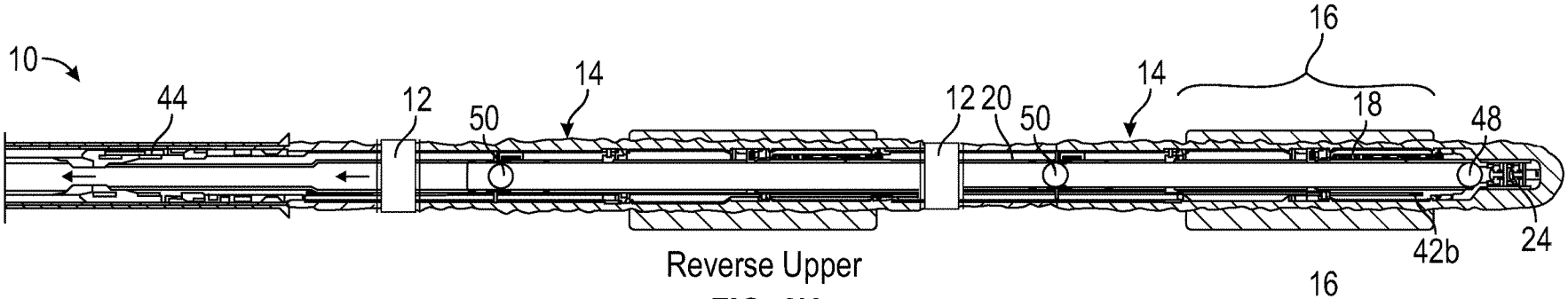
Figure 6I:
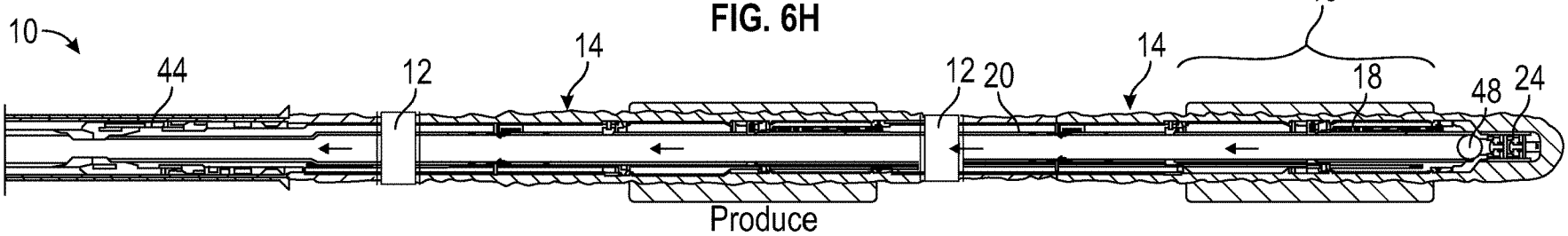

Referring now to FIGS. 6G and 6H, the method further includes dropping an additional dart or ball 50 in the seat 14*f* of the circulating assembly 14 of the upper completion, treating the top well zone, and reversing out the top well zone. In one or more embodiments of the present disclosure, the operation continues with steps identical to those shown in FIGS. 6E and 6F with the lower circulating assembly 14 fully closed, as shown in FIG. 6J, for example. That is, in the method according to one or more embodiments of the present disclosure, open hole or closed hole gravel packing/frac packing treatment operations and subsequent reverse out operations may be performed for a given zone, for each zone to be completed.

Referring now to FIG. 61, the method further includes putting the well in production by opening the downhole flow control valve 18 of the sand control assembly 16, and dissolving the darts/balls in the lower and upper completions to facilitate production through the inner production string 20 to be produced at surface. Opening the flow control valve 18 regulates the reservoir flow. During this step of the method, as shown in FIG. 6J, all other system valves are closed.

FIG. 7-FIG. 9G relate to a completion design for a single trip open hole completion with electric flow control valves (eFCV) integrated with alternate path screens that allows multiple zones to be gravel packed simultaneously through shunts according to one or more embodiments of the present disclosure. The completion design according to one or more embodiments of the present disclosure does not require a service string. Upper and lower completions may be run together in a single trip in this completion design. The completion design according to one or more embodiments of the present disclosure provides full control of the production from each well zone. Because the system allows electric and fiber optic lines to be run through the entire completion length, including the sandface, monitoring of pressure, temperature, and other parameters is possible without needing a wetmate connection between the upper completion and the lower completion. The completion design according to one or more embodiments of the present disclosure may also be suitable for mechanical intervention.

As an example, fluid communication flow paths provided by the completion design of FIG. 7-FIG. 9G may include an outer annulus between the open hole and screens (i.e., where the gravel is pumped); a micro-annulus between screen wires and non-perforated base pipe (i.e., for the gravel pack fluid dehydration); shunts and nozzles associated with the alternate path screens; at least one shunt tube isolation valve; tubing, or ID of the inner production string; and an upper-annulus above the production packer between the casing and the tubing. In one or more embodiments of the present disclosure, the micro-annulus is continuous through the screen section of one given well zone. Moreover, in one or more embodiments of the present disclosure, the shunts associated with the alternate path screens are continuous from the bottom screen joint to the circulation assembly (i.e., through the "lower completion" of the completion string 10). That is, the shunts according to one or more embodiments of the present disclosure are connected from one well zone to the next via isolation or open hole packers and shunt tube isolation valves in the completion string 10.

Figure 7:
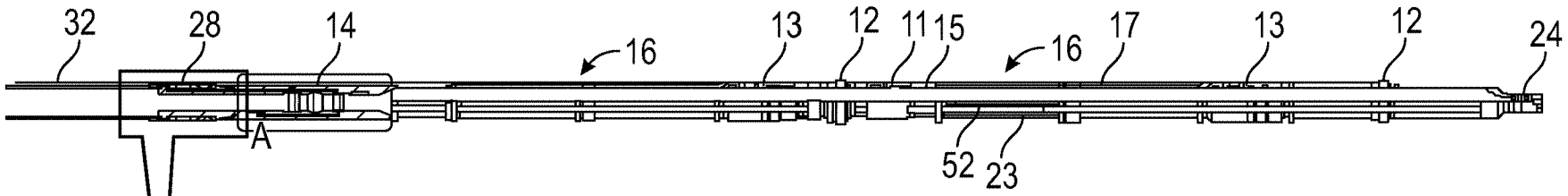
FIG. 7 shows a completion string according to one or more embodiments of the present disclosure.

Referring specifically to FIG. 7, the completion string 10 according to one or more embodiments of the present disclosure is shown. In particular, FIG. 7 a layout of the completion string 10 with its main components for a two zone completion. Although two well zones are shown in FIG. 7, more well zones may be easily added within the scope of the present disclosure. The number of well zones is limited by the friction losses in the shunts and the budget available for electrical power. Advantageously, the completion design shown in FIG. 7 includes only a single string, which makes the completion design suitable to scale down to smaller open hole sizes.

As shown in FIG. 7, the completion string 10 may include at least one isolation packer 12 or open hole packer between a plurality of well zones, including a bottom-most well zone in the uncased section of the wellbore; and a top well zone in the uncased and cased sections of the wellbore. In one or more embodiments of the present disclosure, the isolation packer 12 between the bottom-most well zone and the at least one intermediate well zone may be replaced with an anchor, as shown in FIG. 7, for example. The bottom-most well zone and any intermediate well zone includes from top to bottom an openhole or isolation packer 12, alternate path blank pipe 15, a sand control assembly 16 with non-perforated base pipe 17, and an electric flow control valve (eFCV) 13 cooperative with the sand control assembly 16 for taking returns. Moreover, in one or more embodiments of the present disclosure, the bottom-most well zone may include a washdown shoe 24, and an eFCV 13 and a shunt tube isolation valve (STIV) 11 that cooperate with a sand control assembly 16 may each be disposed uphole of the washdown shoe 24 in the bottom-most well zone. In one or more embodiments of the present disclosure, the top well zone may include a circulating assembly 14 with a valve system and a production packer 28 or control line set top packer that is hydraulically set in casing. According to one or more embodiments of the present disclosure, the top well zone may also include an additional sand control assembly 16 that cooperates with an additional eFCV 13, each of the additional sand control assembly 16 and the additional eFCV 13 being positioned downhole of the production packer 28 as shown in FIG. 7, for example. In one or more embodiments of the present disclosure, the circulating assembly 14 may be disposed in the uncased section of the wellbore. According to one or more embodiments of the present disclosure, the eFCV may be Schlumberger's Manara valve or a full bore electric flow control valve, and the STIV 11 may include an eTrigger for actuation of the valve, for example.

Still referring to FIG. 7, in one or more embodiments of the present disclosure, the sand control assembly 16 includes a pair of screen joints coupled at a screen joint connection. Moreover, each screen joint of the sand control assembly 16 according to one or more embodiments of the present disclosure includes a non-perforated base pipe 17, a filter medium 23 such as a screen disposed around the non-perforated base pipe 17, and a micro-annulus 21 between the filter medium 23 and the non-perforated base pipe 17. The sand control assembly 16 according to one or more embodiments of the present disclosure is unique at least because the micro-annulus 21 is continuous from screen joint to screen joint. That is, the micro-annulus 21 according to one or more embodiments of the present disclosure is continuous through the given sand control assembly 16 of the given well zone. Moreover, the sand control assembly 16 according to one or more embodiments of the present disclosure includes a shunt tube 52. In one or more embodiments of the present disclosure, the shunt tube 52 is continuous from the bottom screen joint of the sand control assembly 16 to the circulating assembly 14 (i.e., through the "lower completion" of the completion string 10). That is, the shunt tube 52 according to one or more embodiments of the present disclosure is connected from one well zone to the next via at least one isolation packer 12 and at least one STIV 11 in the completion string 10. In one or more embodiments of the present disclosure, the filter medium 23 or screen of the sand control assembly 16 may be an alternate path screen such as Schlumberger's MZ-Xpress screen, for example.

Figure 8B:
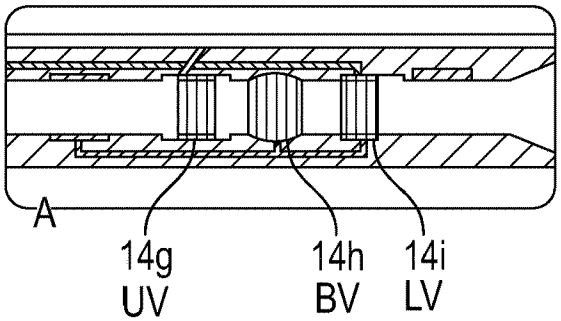
FIG. 8B shows further detail of the circulating assembly of the completion string of FIG. 7 according to one or more embodiments of the present disclosure.
Figure 8E:
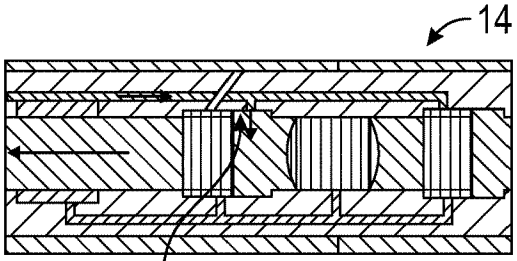
FIGS. 8C-8E show different valve positions of the circulating assembly of FIG. 8B according to one or more embodiments of the present disclosure.
Figure 8D:
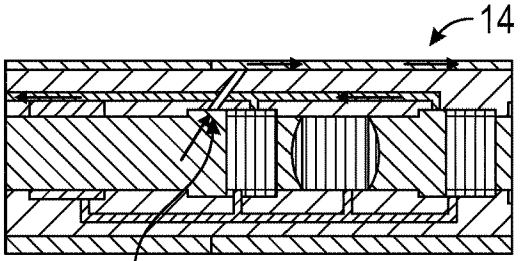
Figure 8C:
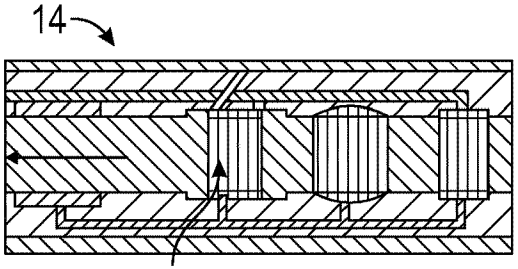
Figure 8A:
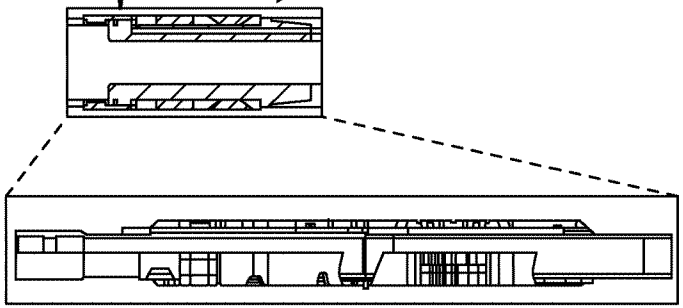
FIG. 8A shows further detail of the production packer of the completion string of FIG. 7 according to one or more embodiments of the present disclosure.

Referring to FIG. 8A, further detail of the production packer 28 of the completion string 10 is shown. In one or more embodiments of the present disclosure, the production packer 28 is a multi-port production packer, such as Schlumberger's XMP packer, for example. In one or more embodiments, the multi-port production packer is tubing conveyed, hydraulically set, and retrievable via cut-to-release. The multi-port production packer according to one or more embodiments of the present disclosure may accommodate a plurality of bypass lines, and may have pressure and temperature ratings of 10,000 psi and 350° F., for example. In one or more embodiments of the present disclosure, the multi-port production packer may have sufficient radial space to accommodate up to six bypass lines.

Still referring to FIG. 8A, the multi-port production packer according to one or more embodiments of the present disclosure may include a bypass port for the return flow in the mandrel. In such embodiments, the multi-port production packer may include three bypass lines (i.e., one electrical line, one fiber optic line, and one circuit integrity line), and the radial space for the remaining three bypass lines may be repurposed and combined to achieve sufficient flow area.

Still referring to FIG. 8A, the multi-port production packer according to one or more embodiments of the present disclosure may be converted to a hydraulic set packer using Schlumberger's control line setting module. Such a configuration requires a control line in the upper completion (from the tubing hanger to the packer 28). Alternatively, an electric rupture disc may be used to set the packer 28. In such embodiments, the actuation mechanism should include two atmospheric chambers. Triggering of the electric rupture disc can flood one of the atmospheric chambers with hydrostatic pressure and allow the piston to work against the other atmospheric chamber, setting the packer 28. In one or more embodiments of the present disclosure, the triggering may be achieved either wirelessly using pressure signals or through a signal conveyed by the electric line 32, such as that shown in FIG. 7, for example.

Referring now to FIGS. 8B-8C, further detail of the circulating assembly 14 of the completion string 10 according to one or more embodiments of the present disclosure is shown. As shown in FIG. 8B, the circulating assembly 14 includes an upper valve 14*g*, a ball valve 14*h*, and a lower valve 14*i*. Further, as shown in FIGS. 8C-8E, the upper valve 14*g* of the circulating assembly 14 is configured to assume a closed position, a gravel packing position, and a reverse out position, according to one or more embodiments of the present disclosure. In other embodiments of the present disclosure, the circulating assembly 14 may include a single valve that is configured to function as the upper valve 14*g*, the ball valve 14*h*, and the lower valve 14*i*, for example. As shown in FIG. 7, due to the shunt tube 52, which is continuous from the bottom screen joint of the sand control assembly 16 to the circulating assembly 14, the completion string 10 according to one or more embodiments of the present disclosure includes only one circulating assembly 14 for all well zones.

Figure 9A:
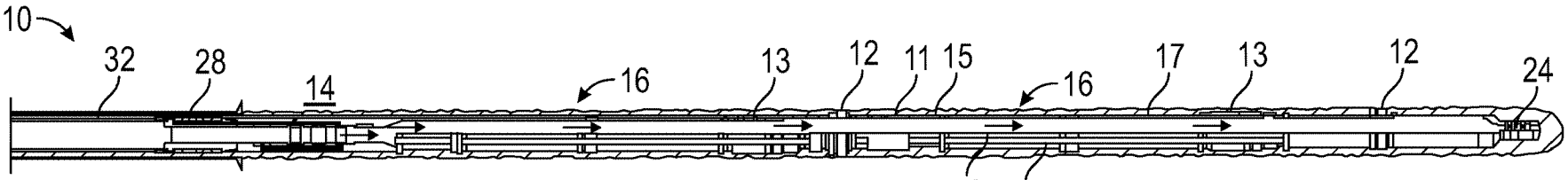
FIGS. 9A-9F show a method of completing a wellbore in a single trip according to one or more embodiments of the present disclosure.

Referring now to FIGS. 9A-9G, a method of completing a wellbore in a single trip according to one or more embodiments of the present disclosure is shown. After making up all of the completion assemblies at the rotary, the completion string 10 may be deployed into the wellbore as shown in FIG. 9A in a method according to one or more embodiments of the present disclosure. In one or more embodiments of the present disclosure, during run-in-hole, fluid may be pumped from the tubing through the completion ID to the washdown shoe 24 and back to surface through the completion annulus as shown in FIG. 9A, for example. As shown in FIG. 9G, while the completion string 10 is run-in-hole, the ball valve 14*h* of the circulating assembly 14 and the STIV 11 may be open, and all other system valves of the completion string 10 may be closed. In one or more embodiments of the present disclosure, the upper valve 14*g* of the circulating assembly 14 may also be open to facilitate adequate filling while running in hole.

Figure 9B:
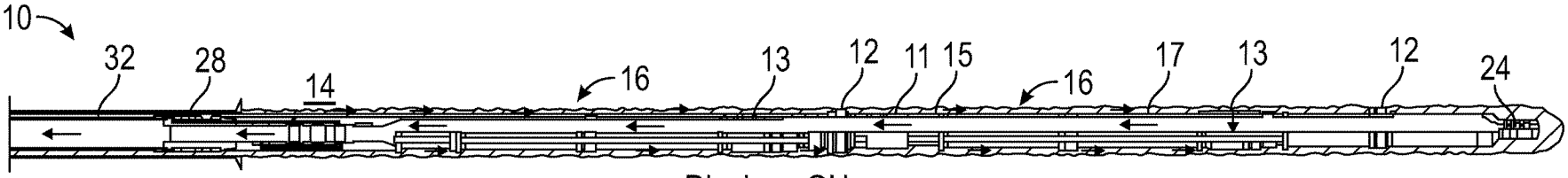

As shown in FIG. 9B, the method further includes pumping displacement fluid through the completion string 10 in a tubing-to-annulus direction when the completion string 10 is in the run-in-hole configuration described above. Alternatively, to protect the screens 23, the bottom-most eFCV 13 may be opened to displace the open hole in an annulus-to-tubing direction.

Figure 9C:
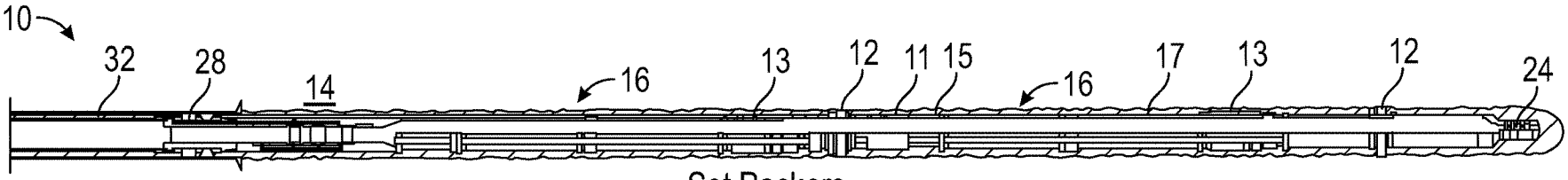

As shown in FIG. 9C, the method further includes setting the production packer 28 via a hydraulic or electric line 32, according to one or more embodiments of the present disclosure. As shown in FIG. 9C, the method further includes setting the at least one isolation packer 12. In one or more embodiments of the present disclosure, the at least one isolation packer 12 may be set electrically via an eTrigger. Further, in one or more embodiments of the present disclosure, all isolation packers 12 in the completion string 10 may be set simultaneously.

Figure 9D:
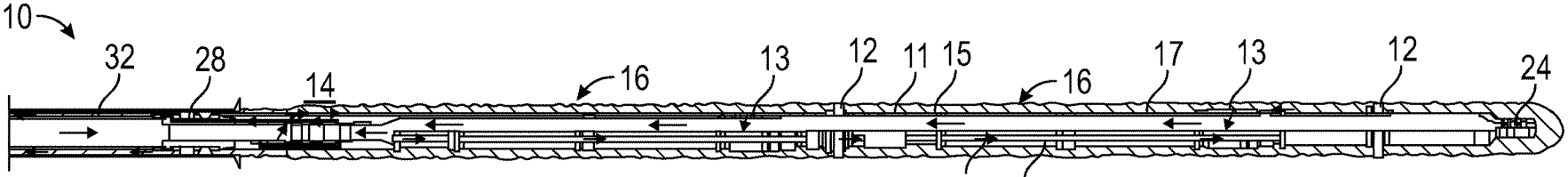

As shown in FIG. 9D, the method further includes gravel packing all well zones in the uncased section of the wellbore. Specifically, the completion string 10 according to one or more embodiments of the present disclosure allows gravel packing of multiple open hole well zones with full zonal isolation. According to one or more embodiments of the present disclosure, during gravel packing, the upper valve 14*g* of the circulating assembly 14 is in the gravel packing position shown in FIG. 8D. Also, during gravel packing, the ball valve 14*h* of the circulating assembly 14 is closed, the lower valve 14*i* of the circulating assembly 14 is open, all eFCV 13 are open, and the STIV 11 is open, as shown in FIG. 9G, for example. In this configuration, during graving packing, treatment fluid (i.e., gravel packing slurry) is pumped down the completion string 10 and out to the open hole through the lower valve 14*i* of the circulating assembly 14. The slurry enters the shunt tubes 52 (i.e., alternate path transport tubes) and is transported to all the well zones (past the isolation packers 12 and the STIV 11). In each well zone, the slurry is diverted to packing tubes through manifolds. The slurry exits the packing tubes through a set of nozzles in each well zone and packs between the isolation packer 12 and the screens. The slurry is dehydrated through the screens 23 of the sand control assembly 16 and the eFCV 13 back to the tubing. That is, fluid enters into the micro-annulus 21 between the non-perforated base pipe 17 and screens 23 and is channeled to the eFCV 13 through the connected micro-annulus 21. Thereafter, in one or more embodiments of the present disclosure, return fluid is diverted to the upper annulus above the production packer 28 through the lower valve 14*i* and the ball valve 14*h* of the circulating assembly 14.

Figure 9E:
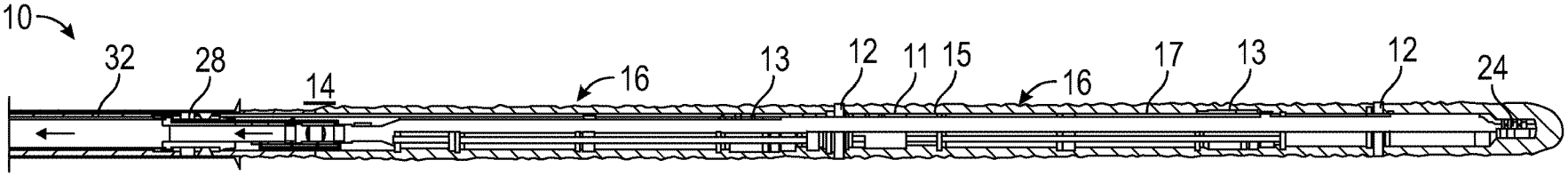

Referring now to FIG. 9E, the method further includes reversing out all gravel packed well zones. During reversing out, the upper valve 14*g* of the circulating assembly 14 is in the reverse out position, the ball valve 14*h* of the circulating assembly 14 is in the closed position, the lower valve 14*i* of the circulating assembly 14 is in the closed position, all eFCVs 13 are closed, and the STIV 11 is open. This configuration of the completion string 10 enables reversing out the excess slurry left in the tubing following the gravel packing procedure. Specifically, fluid may be pumped from the upper annulus to tubing displacing the excess slurry during the reversing out step according to one or more embodiments of the present disclosure.

Figure 9F:
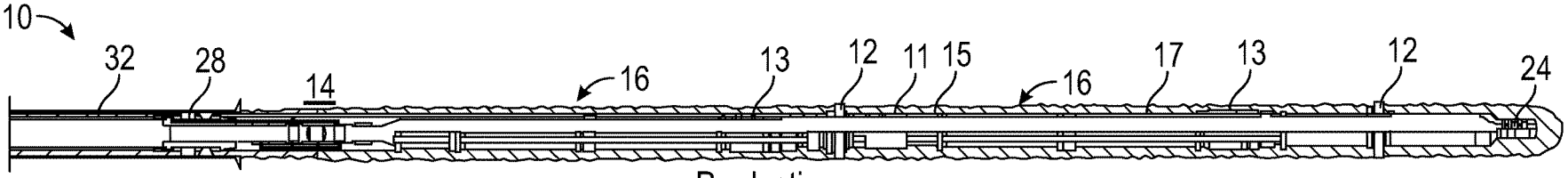

Referring now to FIGS. 9F and 9G, to prepare the completion string 10 for production, the upper valve 14*g* and the lower valve 14*i* of the circulating assembly 14 are set to closed, and the ball valve 14*h* of the circulating assembly 14 is set to the open position. Further, the STIV 11 is moved to the closed position to ensure total zonal isolation through the shunt tube. Moreover, the at least one eFCV 13 is set to the desired choking position, according to one or more embodiments of the present disclosure. In this configuration of the completion string 10, production can start, as fluid is produced through the completion string 10.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A completion string deployed in a wellbore extending through a plurality of well zones, the completion string comprising:

at least one isolation packer positioned between well zones of the plurality of well zones, the plurality of well zones comprising: a bottom-most well zone; and a top well zone;

a washdown shoe disposed in the bottom-most well zone;

a first sand control assembly and a first circulating assembly, each disposed uphole of the washdown shoe in the bottom-most well zone;

wherein the top well zone comprises a return valve assembly and a production packer, wherein the top well zone further comprises a second sand control assembly; and a second circulating assembly, each of the second sand control assembly and the second circulating assembly being downhole of the production packer, wherein the completion string further comprises:

an outer string spanning from the bottom-most well zone to the top well zone; and an inner production string concentrically arranged within the outer string creating an inner-annulus between the outer string and the inner production string, wherein the inner-annulus is continuous from the washdown shoe to the return valve assembly, the inner production string comprising: a first production valve disposed between the first sand control assembly and the first circulating assembly in the bottom-most well zone; and a second production valve disposed between the second sand control assembly and the second circulating assembly in the top well zone.

2. The completion string of claim 1, wherein the first sand control assembly comprises at least one pair of screen joints coupled at a screen joint connection, each screen joint comprising:

a non-perforated base pipe;

a screen disposed around the non-perforated base pipe; and a micro-annulus between the screen and the non-perforated base pipe, the micro-annulus being continuous through the first sand control assembly of the bottom-most well zone;

the first sand control assembly further comprising a downhole flow control valve positioned next to or within one of the screen joints, wherein the outer string comprises the non-perforated base pipe of each screen joint and additional blank pipe.

3. The completion string of claim 1, wherein the plurality of well zones further comprises at least one intermediate well zone between the bottom-most well zone and the top well zone, the completion string further comprising:

a third sand control assembly and a third circulating assembly disposed in the at least one intermediate well zone; and a third production valve disposed between the third sand control assembly and the third circulating assembly in the at least one intermediate well zone.

4. The completion string of claim 3, wherein the first and second sand control assemblies each comprises at least one pair of screen joints coupled at a screen joint connection, wherein each screen joint comprises:

a non-perforated base pipe;

a screen disposed around the non-perforated base pipe; and a micro-annulus between the screen and the non-perforated base pipe, the micro-annulus being continuous through the given sand control assembly of the given zone;

the first and second sand control assemblies each further comprising a downhole flow control valve positioned next to or within one of the screen joints, wherein the outer string comprises the non-perforated base pipe of each screen joint and additional blank pipe.

5. The completion string of claim 1, wherein the return valve assembly is remotely operated.

6. The completion string of claim 1, wherein the first circulating assembly comprises a plurality of valves controlled via a hydraulic-electric system.

7. The completion string of claim 1, wherein the first circulating assembly comprises a reverse valve; a treat valve; and an isolation valve.

8. The completion string of claim 1, wherein the first circulating assembly comprises a valve that is configured to assume at least one of a reverse position; a treat position; and an isolation position.

9. The completion string of claim 1, wherein the first production valve is actuated via a rupture disc.

10. The completion string of claim 1, wherein the at least one isolation packer comprises a melting isolating material.

11. The completion string of claim 1, wherein at least one of an electric line and a fiber optic line runs through an entire length of the completion string.

12. A completion string deployed in a wellbore extending through a plurality of well zones, the completion string comprising:

at least one isolation packer positioned between well zones of the plurality of well zones, the plurality of well zones comprising: a bottom-most well zone; and a top well zone;

a washdown shoe disposed in the bottom-most well zone;

a first sand control assembly and a first circulating assembly, each disposed uphole of the washdown shoe in the bottom-most well zone;

an annular flow module and a production packer, each disposed in the top well zone, the top well zone further comprising a second sand control assembly and a second circulating assembly, each disposed downhole of the production packer, wherein the completion string further comprises:

an outer string spanning from the bottom-most well zone to the top well zone; and an inner production string concentrically arranged within the outer string creating an inner-annulus between the outer string and the inner production string, wherein the inner-annulus is continuous from the washdown shoe in the bottom-most well zone to the annular flow module in the top well zone, wherein the inner-annulus houses a shunt tube system, which facilitates directing flow between well zones of the plurality of well zones, and wherein annular flow above the production packer is directed to the shunt tube system via the annular flow module.

13. The completion string of claim 12, wherein the first and second sand control assemblies each comprises at least one pair of screen joints coupled at a screen joint connection, wherein each screen joint comprises:

a non-perforated base pipe;

a screen disposed around the non-perforated base pipe; and a micro-annulus between the screen and the non-perforated base pipe, the micro-annulus being continuous through the given sand control assembly of the given well zone, the first and second sand control assemblies each further comprising a downhole flow control valve positioned next to or within one of the screen joints, wherein the inner production string is continuous with the non-perforated base pipe.

14. The completion string of claim 12, wherein the plurality of well zones further comprises at least one intermediate well zone between the bottom-most well zone and the top well zone, the completion string further comprising:

a third sand control assembly and a third circulating assembly disposed in the at least one intermediate well zone.

15. The completion string of claim 13, wherein the shunt tube system comprises a common annular tube disposed in the top well zone of the inner-annulus, wherein the common annular tube splits for each well zone into a common return tube and a common reverse tube, wherein the common reverse tube is connected to a reverse port of each circulating assembly, wherein the common return tube splits at a top of the bottom-most screen joint of a given well zone into a ported tube, and wherein each of the common return tube and the common reverse tube comprises a check valve.

16. The completion string of claim 13, wherein each circulating assembly comprises:

a reverse port;

a treat port; and a seat for accommodating a dart, wherein the reverse port and the treat port are configured to open when the dart lands in the seat, and wherein each circulating assembly is controlled via a hydraulic-electric system.

17. A method of completing a wellbore comprising:

deploying the completion string of claim 16 in the wellbore;

pumping displacement fluid through the inner production string, through the washdown shoe, and back to surface via an outer annulus between an uncased section of the wellbore and the screens of the first and second sand control assemblies;

setting the production packer;

dropping a washdown shoe deactivation mechanism to set the at least one isolation packer;

dropping a first dart in the seat of the first circulating assembly;

treating the bottom-most well zone;

reversing out the bottom-most well zone;

dropping a second dart in the seat of the second circulating assembly;

treating the top well zone;

reversing out the top well zone; and opening the downhole flow control valve of the first and second sand control assemblies, and dissolving the first and second darts to facilitate production through the inner production string.

18. A completion string deployed in a wellbore extending through a plurality of well zones, the completion string comprising:

at least one isolation packer positioned between well zones of the plurality of well zones, the plurality of well zones comprising: a bottom-most well zone; and a top well zone;

a washdown shoe disposed in the bottom-most well zone;

a first sand control assembly disposed uphole of the washdown shoe in the bottom-most well zone, wherein the first sand control assembly cooperates with a first electric flow control valve and a shunt tube isolation valve, each disposed in the bottom-most well zone, wherein the top well zone comprises: a circulating assembly; and a production packer adjacent to the circulating assembly, wherein the top well zone further comprises a second sand control assembly that cooperates with a second electric flow control valve, each of the second sand control assembly and the second electric flow control valve being positioned downhole of the production packer, and wherein each of the first and second sand control assemblies comprises at least one shunt tube.

19. The completion string of claim 18, wherein the first and second sand control assemblies each further comprises at least one pair of screen joints coupled at a screen joint connection, wherein each screen joint comprises:

a non-perforated base pipe;

a screen disposed around the non-perforated base pipe; and a micro-annulus between the screen and the non-perforated base pipe, the micro-annulus being continuous through the given sand control assembly of the given zone, wherein the first and second electric flow control valves are positioned next to or within one of the screen joints of the first and second sand control assemblies, respectively.

20. The completion string of claim 18, wherein the production packer is a multi-port production packer.

21. The completion string of claim 18, wherein the circulating assembly comprises: an upper valve; a ball valve; and a lower valve.

22. The completion string of claim 21, wherein the upper valve of the circulating assembly is configured to assume a closed position; a gravel packing position; and a reverse out position.

23. A method of completing a wellbore comprising:

deploying the completion string of claim 22 in the wellbore;

pumping displacement fluid through the completion string in a tubing-to-annulus direction or in an annulus-to-tubing direction;

setting the production packer;

setting the at least one isolation packer;

gravel packing all well zones in an uncased section of the wellbore, wherein during the gravel packing step, the upper valve of the circulating assembly is in the gravel packing position, the ball valve of the circulating assembly is closed, the lower valve of the circulating assembly is open, the first and second electric flow control valves are open, and the shunt tube isolation valve is open;

reversing out all gravel packed well zones, wherein during the reversing out step, the upper valve of the circulating assembly is in the reverse out position, the ball valve of the circulating assembly is in the closed position, the lower valve of the circulating assembly is in the closed position, the first and second electric flow control valves are closed, and the shunt tube isolation valve is open; and closing the upper valve of the circulating assembly;

opening the ball valve of the circulating assembly;

closing the shunt tube isolation valve setting the first and second electric flow control valves to a desired choking position; and producing fluid through the completion string.

* * * * *